US010069230B1

(12) United States Patent
Veeramani

(10) Patent No.: US 10,069,230 B1
(45) Date of Patent: Sep. 4, 2018

(54) BOARD MOUNTABLE CONNECTORS FOR RIBBON CABLES WITH SMALL DIAMETER WIRES AND METHODS FOR MAKING

(71) Applicant: Microfabrica Inc., Van Nuys, CA (US)

(72) Inventor: Arun S. Veeramani, Vista, CA (US)

(73) Assignee: Microfabrica Inc., Van Nuys, CA (US)

( * ) Notice: Subject to any disclaimer, the term of this patent is extended or adjusted under 35 U.S.C. 154(b) by 0 days.

(21) Appl. No.: 15/428,139

(22) Filed: Feb. 8, 2017

Related U.S. Application Data

(60) Provisional application No. 62/292,576, filed on Feb. 8, 2016.

(51) Int. Cl.

| | |
|---|---|
| ***H01R 4/26*** | (2006.01) |
| ***H01R 12/79*** | (2011.01) |
| ***C25D 5/02*** | (2006.01) |
| ***C25D 7/00*** | (2006.01) |
| ***H01R 4/2412*** | (2018.01) |
| ***H01R 4/62*** | (2006.01) |

(52) U.S. Cl.
CPC ..... *H01R 12/79* (2013.01); *C25D 5/022* (2013.01); *C25D 7/00* (2013.01); *H01R 4/2412* (2013.01); *H01R 4/62* (2013.01)

(58) Field of Classification Search
CPC ..... H01R 9/0757; H01R 4/26; H01R 9/07; H01R 9/075; H01R 12/59; H01R 12/592; H01R 12/594; H01R 12/61; H01R 12/616; H01R 12/65; H01R 12/67; H01R 12/625; H01R 4/24; H01R 4/2433; H01R 4/2429; H01R 4/2412; H01R 4/2416; H01R 4/242; H01R 13/582; H01R 13/5829; H01R 13/506; H01R 13/6273
See application file for complete search history.

(56) References Cited

U.S. PATENT DOCUMENTS

| | | | | |
|---|---|---|---|---|
| 6,383,013 | B1 * | 5/2002 | Ghesla | G01D 11/24 439/408 |
| 8,717,054 | B2 * | 5/2014 | Chen | G01R 1/0483 324/755.05 |
| 9,537,236 | B2 * | 1/2017 | Neu | H01R 13/6335 |
| 9,543,664 | B2 * | 1/2017 | Sabo | H01R 4/2433 |
| 9,553,401 | B2 * | 1/2017 | Mathews | H01R 12/772 |
| 2004/0011167 | A1 * | 1/2004 | Miwa | H01R 12/675 83/13 |
| 2007/0054540 | A1 * | 3/2007 | Takeda | H01R 12/592 439/404 |
| 2011/0308562 | A1 * | 12/2011 | Shufflebotham | H01L 31/02008 136/244 |
| 2015/0194742 | A1 * | 7/2015 | Shigezane | H01R 13/501 439/395 |
| 2016/0134034 | A1 * | 5/2016 | Neu | H01R 13/6335 439/152 |

* cited by examiner

*Primary Examiner* — Michael A Lyons
*Assistant Examiner* — Matthew T Dzierzynski
(74) *Attorney, Agent, or Firm* — Dennis R. Smalley

(57) ABSTRACT

Embodiments are directed to board (e.g. PCB) mountable connectors for small gauge ribbon cables having a plurality of 28-40 AWG wires wherein the connectors are fabricated from a plurality of adhered layers comprising at least on metal.

19 Claims, 15 Drawing Sheets

1218 = spikes
1241 = direction of cable insertion
1244 = direction of cable pull out

BOARD MOUNTABLE CONNECTORS FOR RIBBON CABLES WITH SMALL DIAMETER WIRES AND METHODS FOR MAKING

RELATED APPLICATIONS

This application claims the benefit of U.S. Provisional Patent Application No. 62/292,576, filed Feb. 8, 2016. This provisional application is incorporated herein by reference as if set forth in full herein.

FIELD OF THE INVENTION

The present invention relates generally to board mounted connectors for wires and more particularly to board mounted connectors for multi-wire ribbon cables (e.g. two wires to forty wires or more) of small wire diameter (e.g. 30 gauge or finer). Some embodiments relate to multi-layer, multi-material electrochemical methods for forming micro-scale or millimeter scale structures, parts, components, or devices (e.g. such connectors or connector elements) which may, or may not, include both metal and dielectric elements or portions.

BACKGROUND OF THE INVENTION

Electrochemical Fabrication:

An electrochemical fabrication technique for forming three-dimensional structures from a plurality of adhered layers is being commercially pursued by Microfabrica® Inc. (formerly MEMGen Corporation) of Van Nuys, Calif. under the process names EFAB™ and MICA FREEFORM®.

Various electrochemical fabrication techniques were described in U.S. Pat. No. 6,027,630, issued on Feb. 22, 2000 to Adam Cohen. Some embodiments of this electrochemical fabrication technique allow the selective deposition of a material using a mask that includes a patterned conformable material on a support structure that is independent of the substrate onto which plating will occur. When desiring to perform an electrodeposition using the mask, the conformable portion of the mask is brought into contact with a substrate, but not adhered or bonded to the substrate, while in the presence of a plating solution such that the contact of the conformable portion of the mask to the substrate inhibits deposition at selected locations. For convenience, these masks might be generically called conformable contact masks; the masking technique may be generically called a conformable contact mask plating process. More specifically, in the terminology of Microfabrica Inc. such masks have come to be known as INSTANT MASKS™ and the process known as INSTANT MASKING™ or INSTANT MASK™ plating. Selective depositions using conformable contact mask plating may be used to form single selective deposits of material or may be used in a process to form multi-layer structures. The teachings of the '630 patent are hereby incorporated herein by reference as if set forth in full herein. Since the filing of the patent application that led to the above noted patent, various papers about conformable contact mask plating (i.e. INSTANT MASKING) and electrochemical fabrication have been published:

(1) A. Cohen, G. Zhang, F. Tseng, F. Mansfeld, U. Frodis and P. Will, "EFAB: Batch production of functional, fully-dense metal parts with micro-scale features", Proc. 9th Solid Freeform Fabrication, The University of Texas at Austin, p 161, August 1998.

(2) A. Cohen, G. Zhang, F. Tseng, F. Mansfeld, U. Frodis and P. Will, "EFAB: Rapid, Low-Cost Desktop Micromachining of High Aspect Ratio True 3-D MEMS", Proc. 12th IEEE Micro Electro Mechanical Systems Workshop, IEEE, p 244, January 1999.

(3) A. Cohen, "3-D Micromachining by Electrochemical Fabrication", Micromachine Devices, March 1999.

(4) G. Zhang, A. Cohen, U. Frodis, F. Tseng, F. Mansfeld, and P. Will, "EFAB: Rapid Desktop Manufacturing of True 3-D Microstructures", Proc. 2nd International Conference on Integrated MicroNanotechnology for Space Applications, The Aerospace Co., April 1999.

(5) F. Tseng, U. Frodis, G. Zhang, A. Cohen, F. Mansfeld, and P. Will, "EFAB: High Aspect Ratio, Arbitrary 3-D Metal Microstructures using a Low-Cost Automated Batch Process", 3rd International Workshop on High Aspect Ratio MicroStructure Technology (HARMST'99), June 1999.

(6) A. Cohen, U. Frodis, F. Tseng, G. Zhang, F. Mansfeld, and P. Will, "EFAB: Low-Cost, Automated Electrochemical Batch Fabrication of Arbitrary 3-D Microstructures", Micromachining and Microfabrication Process Technology, SPIE 1999 Symposium on Micromachining and Microfabrication, September 1999.

(7) F. Tseng, G. Zhang, U. Frodis, A. Cohen, F. Mansfeld, and P. Will, "EFAB: High Aspect Ratio, Arbitrary 3-D Metal Microstructures using a Low-Cost Automated Batch Process", MEMS Symposium, ASME 1999 International Mechanical Engineering Congress and Exposition, November, 1999.

(8) A. Cohen, "Electrochemical Fabrication (EFAB™)", Chapter 19 of The MEMS Handbook, edited by Mohamed Gad-El-Hak, CRC Press, 2002.

(9) Microfabrication—Rapid Prototyping's Killer Application", pages 1-5 of the Rapid Prototyping Report, CAD/CAM Publishing, Inc., June 1999.

The disclosures of these nine publications are hereby incorporated herein by reference as if set forth in full herein.

An electrochemical deposition process for forming multilayer structures may be carried out in a number of different ways as set forth in the above patent and publications. In one form, this process involves the execution of three separate operations during the formation of each layer of the structure that is to be formed:

1. Selectively depositing at least one material by electrodeposition upon one or more desired regions of a substrate. Typically this material is either a structural material or a sacrificial material.
2. Then, blanket depositing at least one additional material by electrodeposition so that the additional deposit covers both the regions that were previously selectively deposited onto, and the regions of the substrate that did not receive any previously applied selective depositions. Typically this material is the other of a structural material or a sacrificial material.
3. Finally, planarizing the materials deposited during the first and second operations to produce a smoothed surface of a first layer of desired thickness having at least one region containing the at least one material and at least one region containing at least the one additional material.

After formation of the first layer, one or more additional layers may be formed adjacent to an immediately preceding layer and adhered to the smoothed surface of that preceding layer. These additional layers are formed by repeating the first through third operations one or more times wherein the formation of each subsequent layer treats the previously formed layers and the initial substrate as a new and thickening substrate.

Once the formation of all layers has been completed, at least a portion of at least one of the materials deposited is generally removed by an etching process to expose or release the three-dimensional structure that was intended to be formed. The removed material is a sacrificial material while the material that forms part of the desired structure is a structural material.

One method of performing the selective electrodeposition involved in the first operation is by conformable contact mask plating. In this type of plating, one or more conformable contact (CC) masks are first formed. The CC masks include a support structure onto which a patterned conformable dielectric material is adhered or formed. The conformable material for each mask is shaped in accordance with a particular cross-section of material to be plated (the pattern of conformable material is complementary to the pattern of material to be deposited). In such a process, at least one CC mask is used for each unique cross-sectional pattern that is to be plated.

The support for a CC mask may be a plate-like structure formed of a metal that is to be selectively electroplated and from which material to be plated will be dissolved. In this typical approach, the support will act as an anode in an electroplating process. In an alternative approach, the support may instead be a porous or otherwise perforated material through which deposition material will pass during an electroplating operation on its way from a distal anode to a deposition surface. In either approach, it is possible for multiple CC masks to share a common support, i.e. the patterns of conformable dielectric material for plating multiple layers of material may be located in different areas of a single support structure. When a single support structure contains multiple plating patterns, the entire structure is referred to as the CC mask while the individual plating masks may be referred to as "submasks". In the present application such a distinction will be made only when relevant to a specific point being made.

In preparation for performing the selective deposition of the first operation, the conformable portion of the CC mask is placed in registration with and pressed against a selected portion of (1) the substrate, (2) a previously formed layer, or (3) a previously deposited portion of a layer on which deposition is to occur. The pressing together of the CC mask and relevant substrate occur in such a way that all openings, in the conformable portions of the CC mask contain plating solution. The conformable material of the CC mask that contacts the substrate acts as a barrier to electrodeposition while the openings in the CC mask that are filled with electroplating solution act as pathways for transferring material from an anode (e.g. the CC mask support) to the non-contacted portions of the substrate (which act as a cathode during the plating operation) when an appropriate potential and/or current are supplied.

An example of a CC mask and CC mask plating are shown in FIGS. 1A-1C. FIG. 1A shows a side view of a CC mask 8 consisting of a conformable or deformable (e.g. elastomeric) insulator 10 patterned on an anode 12. The anode has two functions. One is as a supporting material for the patterned insulator 10 to maintain its integrity and alignment since the pattern may be topologically complex (e.g., involving isolated "islands" of insulator material). The other function is as an anode for the electroplating operation. FIG. 1A also depicts a substrate 6, separated from mask 8, onto which material will be deposited during the process of forming a layer. CC mask plating selectively deposits material 22 onto substrate 6 by simply pressing the insulator against the substrate then electrodepositing material through apertures 26*a* and 26*b* in the insulator as shown in FIG. 1B. After deposition, the CC mask is separated, preferably non-destructively, from the substrate 6 as shown in FIG. 1C.

The CC mask plating process is distinct from a "through-mask" plating process in that in a through-mask plating process the separation of the masking material from the substrate would occur destructively. Furthermore in a through mask plating process, opening in the masking material are typically formed while the masking material is in contact with and adhered to the substrate. As with through-mask plating, CC mask plating deposits material selectively and simultaneously over the entire layer. The plated region may consist of one or more isolated plating regions where these isolated plating regions may belong to a single structure that is being formed or may belong to multiple structures that are being formed simultaneously. In CC mask plating as individual masks are not intentionally destroyed in the removal process, they may be usable in multiple plating operations.

Another example of a CC mask and CC mask plating is shown in FIGS. 1D-1G. FIG. 1D shows an anode 12' separated from a mask 8' that includes a patterned conformable material 10' and a support structure 20. FIG. 1D also depicts substrate 6 separated from the mask 8'. FIG. 1E illustrates the mask 8' being brought into contact with the substrate 6. FIG. 1F illustrates the deposit 22' that results from conducting a current from the anode 12' to the substrate 6. FIG. 1G illustrates the deposit 22' on substrate 6 after separation from mask 8'. In this example, an appropriate electrolyte is located between the substrate 6 and the anode 12' and a current of ions coming from one or both of the solution and the anode are conducted through the opening in the mask to the substrate where material is deposited. This type of mask may be referred to as an anodeless INSTANT MASK™ (AIM) or as an anodeless conformable contact (ACC) mask.

Unlike through-mask plating, CC mask plating allows CC masks to be formed completely separate from the substrate on which plating is to occur (e.g. separate from a three-dimensional (3D) structure that is being formed). CC masks may be formed in a variety of ways, for example, using a photolithographic process. All masks can be generated simultaneously, e.g. prior to structure fabrication rather than during it. This separation makes possible a simple, low-cost, automated, self-contained, and internally-clean "desktop factory" that can be installed almost anywhere to fabricate 3D structures, leaving any required clean room processes, such as photolithography to be performed by service bureaus or the like.

An example of the electrochemical fabrication process discussed above is illustrated in FIGS. 2A-2F. These figures show that the process involves deposition of a first material 2 which is a sacrificial material and a second material 4 which is a structural material. The CC mask 8, in this example, includes a patterned conformable material (e.g. an elastomeric dielectric material) 10 and a support 12 which is made from deposition material 2. The conformal portion of the CC mask is pressed against substrate 6 with a plating solution 14 located within the openings 16 in the conformable material 10. An electric current, from power supply 18, is then passed through the plating solution 14 via (a) support 12 which doubles as an anode and (b) substrate 6 which doubles as a cathode. FIG. 2A illustrates that the passing of current causes material 2 within the plating solution and material 2 from the anode 12 to be selectively transferred to and plated on the substrate 6. After electroplating the first deposition material 2 onto the substrate 6 using CC mask 8, the CC mask 8 is removed as shown in FIG. 2B. FIG. 2C depicts the second deposition material 4 as having been blanket-deposited (i.e. non-selectively deposited) over the previously deposited first deposition material 2 as well as over the other portions of the substrate 6. The blanket deposition occurs by electroplating from an anode (not shown), composed of the second material, through an appropriate plating solution (not shown), and to the cathode/substrate 6. The entire two-material layer is then planarized to achieve precise thickness and flatness as shown in FIG. 2D. After repetition of this process for all layers, the multi-layer structure 20 formed of the second material 4 (i.e. structural material) is embedded in first material 2 (i.e. sacrificial material) as shown in FIG. 2E. The embedded structure is etched to yield the desired device, i.e. structure 20, as shown in FIG. 2F.

Various components of an exemplary manual electrochemical fabrication system 32 are shown in FIGS. 3A-3C. The system 32 consists of several subsystems 34, 36, 38, and 40. The substrate holding subsystem 34 is depicted in the upper portions of each of FIGS. 3A-3C and includes several components: (1) a carrier 48, (2) a metal substrate 6 onto which the layers are deposited, and (3) a linear slide 42 capable of moving the substrate 6 up and down relative to the carrier 48 in response to drive force from actuator 44. Subsystem 34 also includes an indicator 46 for measuring differences in vertical position of the substrate which may be used in setting or determining layer thicknesses and/or deposition thicknesses. The subsystem 34 further includes feet 68 for carrier 48 which can be precisely mounted on subsystem 36.

The CC mask subsystem 36 shown in the lower portion of FIG. 3A includes several components: (1) a CC mask 8 that is actually made up of a number of CC masks (i.e. submasks) that share a common support/anode 12, (2) precision X-stage 54, (3) precision Y-stage 56, (4) frame 72 on which the feet 68 of subsystem 34 can mount, and (5) a tank 58 for containing the electrolyte 16. Subsystems 34 and 36 also include appropriate electrical connections (not shown) for connecting to an appropriate power source (not shown) for driving the CC masking process.

The blanket deposition subsystem 38 is shown in the lower portion of FIG. 3B and includes several components: (1) an anode 62, (2) an electrolyte tank 64 for holding plating solution 66, and (3) frame 74 on which feet 68 of subsystem 34 may sit. Subsystem 38 also includes appropriate electrical connections (not shown) for connecting the anode to an appropriate power supply (not shown) for driving the blanket deposition process.

The planarization subsystem 40 is shown in the lower portion of FIG. 3C and includes a lapping plate 52 and associated motion and control systems (not shown) for planarizing the depositions.

In addition to teaching the use of CC masks for electrodeposition purposes, the '630 patent also teaches that the CC masks may be placed against a substrate with the polarity of the voltage reversed and material may thereby be selectively removed from the substrate. It indicates that such removal processes can be used to selectively etch, engrave, and polish a substrate, e.g., a plaque.

The '630 patent further indicates that the electroplating methods and articles disclosed therein allow fabrication of devices from thin layers of materials such as, e.g., metals, polymers, ceramics, and semiconductor materials. It further indicates that although the electroplating embodiments described therein have been described with respect to the use of two metals, a variety of materials, e.g., polymers, ceramics and semiconductor materials, and any number of metals can be deposited either by the electroplating methods therein, or in separate processes that occur throughout the electroplating method. It indicates that a thin plating base can be deposited, e.g., by sputtering, over a deposit that is insufficiently conductive (e.g., an insulating layer) so as to enable subsequent electroplating. It also indicates that multiple support materials (i.e. sacrificial materials) can be included in the electroplated element allowing selective removal of the support materials.

The '630 patent additionally teaches that the electroplating methods disclosed therein can be used to manufacture elements having complex microstructure and close tolerances between parts. An example is given with the aid of FIGS. 14A-14E of that patent. In the example, elements having parts that fit with close tolerances, e.g., having gaps between about 1-5 um, including electroplating the parts of the device in an unassembled, preferably pre-aligned state. In such embodiments, the individual parts can be moved into operational relation with each other or they can simply fall together. Once together the separate parts may be retained by clips or the like.

Another method for forming microstructures from electroplated metals (i.e. using electrochemical fabrication techniques) is taught in U.S. Pat. No. 5,190,637 to Henry Guckel, entitled "Formation of Microstructures by Multiple Level Deep X-ray Lithography with Sacrificial Metal Layers". This patent teaches the formation of metal structure utilizing through mask exposures. A first layer of a primary metal is electroplated onto an exposed plating base to fill a void in a photoresist (the photoresist forming a through mask having a desired pattern of openings), the photoresist is then removed and a secondary metal is electroplated over the first layer and over the plating base. The exposed surface of the secondary metal is then machined down to a height which exposes the first metal to produce a flat uniform surface extending across both the primary and secondary metals. Formation of a second layer may then begin by applying a photoresist over the first layer and patterning it (i.e. to form a second through mask) and then repeating the process that was used to produce the first layer to produce a second layer of desired configuration. The process is repeated until the entire structure is formed and the secondary metal is removed by etching. The photoresist is formed over the plating base or previous layer by casting and patterning of the photoresist (i.e. voids formed in the photoresist) are formed by exposure of the photoresist through a patterned mask via X-rays or UV radiation and development of the exposed or unexposed areas.

The '637 patent teaches the locating of a plating base onto a substrate in preparation for electroplating materials onto the substrate. The plating base is indicated as typically involving the use of a sputtered film of an adhesive metal, such as chromium or titanium, and then a sputtered film of the metal that is to be plated. It is also taught that the plating base may be applied over an initial layer of sacrificial material (i.e. a layer or coating of a single material) on the substrate so that the structure and substrate may be detached if desired. In such cases after formation of the structure the sacrificial material forming part of each layer of the structure may be removed along with the initial sacrificial layer to free the structure. Substrate materials mentioned in the '637 patent include silicon, glass, metals, and silicon with protected semiconductor devices. A specific example of a plating base includes about 150 angstroms of titanium and about 300 angstroms of nickel, both of which are sputtered at a temperature of 160° C. In another example, it is indicated that the plating base may consist of 150 angstroms of titanium and 150 angstroms of nickel where both are applied by sputtering.

Electrochemical Fabrication provides the ability to form prototypes and commercial quantities of miniature objects, parts, structures, devices, and the like at reasonable costs and in reasonable times. In fact, Electrochemical Fabrication is an enabler for the formation of many structures that were hitherto impossible to produce. Electrochemical Fabrication opens the spectrum for new designs and products in many industrial fields. Even though Electrochemical Fabrication offers this new capability and it is understood that Electrochemical Fabrication techniques can be combined with designs and structures known within various fields to produce new structures, certain uses for Electrochemical Fabrication provide designs, structures, capabilities and/or features not known or obvious in view of the state of the art.

Various types of connectors exist for connecting ribbon cables to boards (e.g. PCBs) including ZIF connectors and IDC connectors but a need exists for reliably connecting finer wires to boards without damaging the wires. Furthermore some connectors may benefit by having improved characteristics, reduced fabrication times, reduced fabrication costs, simplified fabrication processes, greater versatility in device design, improved selection of materials, improved material properties, more cost effective and less risky production of such connectors, and/or more independence between geometric configuration and the selected fabrication process.

SUMMARY OF THE INVENTION

It is an object of some embodiments of the invention to provide an improved method for forming multi-layer three-dimensional structures that can function as board mounted electrical connectors (either single use or multiuse) that incorporate both metals and dielectrics.

It is an object of some embodiments of the invention to provide improved a millimeter-scale or microscale connectors.

Other objects and advantages of various embodiments of the invention will be apparent to those of skill in the art upon review of the teachings herein. The various embodiments of the invention, set forth explicitly herein or otherwise ascertained from the teachings herein, may address one or more of the above objects alone or in combination, or alternatively may address some other object ascertained from the teachings herein. It is not necessarily intended that all objects be addressed by any single aspect of the invention even though that may be the case with regard to some aspects.

In a first aspect of the invention a board mountable connector, includes: (a) a plurality of electrically conductive isolated spikes comprising a distal end and a proximal end, where the distal end of each spike is configured to engage an individual wire of a multi-wire ribbon cable; (b) a plurality of pedestals which are each configured to connect to the proximal end of a spike of the plurality of spikes with each pedestal including a board mounting location; (c) a latching element; and (d) a clamping arm rotatably mounted to move from an open position to a latched position when engaged with the latching element such that wires of a ribbon cable, when inserted between the arm and the spikes, make electrical contact with a respective spike, wherein the spikes, pedestals and latching arm are configured to engage a ribbon cable having wires smaller than 28 AWG.

In a second aspect of the invention a board mountable connector having a plurality of individual contactor elements, includes (a) a plurality of electrically conductive isolated spikes comprising a distal end and a proximal end, where the distal end of each spike is configured to engage an individual wire of a multi-wire ribbon cable; (b) a plurality of pedestals which each connect, directly or indirectly to the proximal end of a respective spike of the plurality of spikes with each pedestal electrically isolated from the other pedestals and with each comprising a curved seat for locating an insulator of a wire; (c) a plurality of base elements connecting the respective spikes to a proximal end of respective back stop elements; and (d) a plurality of cap elements located above respective spikes and connected to the a distal end of respective back elements; wherein spacings between respective lids and seats and seats and spikes is configured to allow insertion of a wire of a multi-wire ribbon cable between the lids and the seats while bending back the spike; wherein spacings between respective lids and seats and seats and spikes is configured such that partial retraction of the wires causes the spikes to straighten, penetrate an insulating coating on the respective wire and make electrical contact; wherein the spikes, lids, and stops are configured to engage a ribbon cable having wires smaller than 28 AWG, and wherein each individual contactor element comprises at least one of the spikes, pedestals, base elements, and cap elements.

Other aspects of the invention will be understood by those of skill in the art upon review of the teachings herein. Other aspects of the invention may involve apparatus that can be used in implementing one or more of the above method aspects of the invention. Other aspects of the invention provide other improved methods for making such connectors, other improved connectors, or improved methods of using such connectors or mounting such connectors to circuit boards. These other aspects of the invention may provide various combinations of the aspects presented above as well as provide other configurations, structures, functional relationships, and processes that have not been specifically set forth above.

BRIEF DESCRIPTION OF THE DRAWINGS

FIGS. 1A-10 schematically depict side views of various stages of a CC mask plating process, while FIGS. 1D-1G schematically depict side views of various stages of a CC mask plating process using a different type of CC mask.

FIG. 6 provides a perspective view of the top of the connector of FIGS. 5A and 5B with the latch removed so that the individual contactor spikes may be better seen.

FIG. 7 depicts an embodiment of the device that includes an additional material for holding the individual leads and contactors in position at least until board mounting has occurred.

In FIG. 8A the connector is shown with the latch open. In FIG. 8B the connector is show with a 4 wire ribbon cable inserted into the connector. In FIG. 8C the latch is shown as closed with the latch hook engaging the latch seat and with the spikes puncturing the coatings on the wires and engaging the wires.

FIG. 9A illustrates an example of a compliant member engaging each wire opposite the spikes while

FIG. 10 provides a close up view of two wire engagement regions on a connector where each wire engagement location includes two spikes arranged axially along a short length of their respective wires (wires are not shown) such that both spikes encounter the wires near their ends and on or near their center lines.

DETAILED DESCRIPTION OF PREFERRED EMBODIMENTS

Electrochemical Fabrication in General

FIGS. 1A-1G, 2A-2F, and 3A-3C illustrate various features of one form of electrochemical fabrication. Other electrochemical fabrication techniques are set forth in the '630 patent referenced above, in the various previously incorporated publications, in various other patents and patent applications incorporated herein by reference. Still others may be derived from combinations of various approaches described in these publications, patents, and applications, or are otherwise known or ascertainable by those of skill in the art from the teachings set forth herein. All of these techniques may be combined with those of the various embodiments of various aspects of the invention to yield enhanced embodiments. Still other embodiments may be derived from combinations of the various embodiments explicitly set forth herein.

Figure 1A:
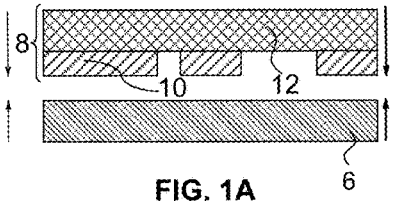
FIG. 1A (PRIOR ART)
Figure 1B:
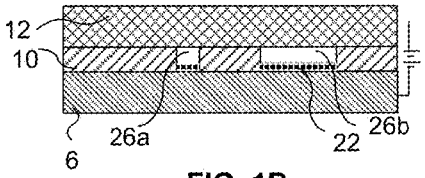
FIG. 1B (PRIOR ART)
Figure 1C:
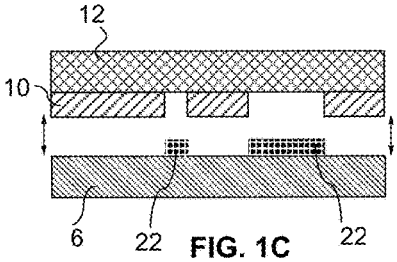
FIG. 1C (PRIOR ART)
Figure 1D:
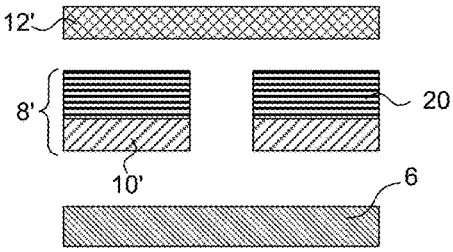
FIG. 1D (PRIOR ART)
Figure 1E:
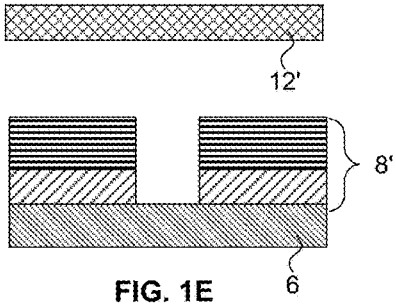
FIG. 1E (PRIOR ART)
Figure 1F:
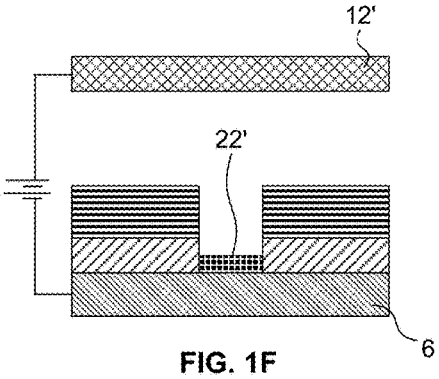
FIG. 1F (PRIOR ART)
Figure 1G:
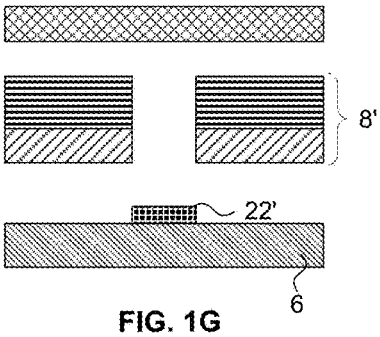
FIG. 1G (PRIOR ART)
Figure 2A:
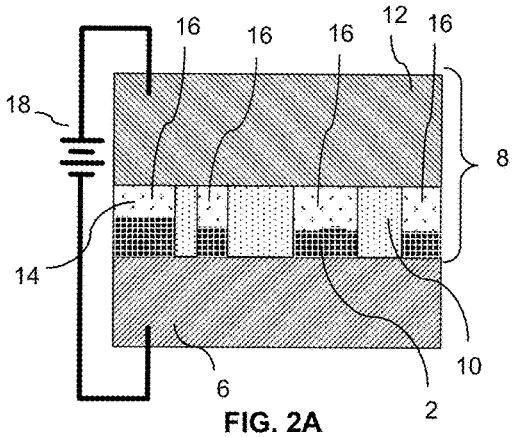
FIG. 2A (PRIOR ART)
FIGS. 2A-2F schematically depict side views of various stages of an electrochemical fabrication process as applied to the formation of a particular structure where a sacrificial material is selectively deposited while a structural material is blanket deposited.
Figure 2B:
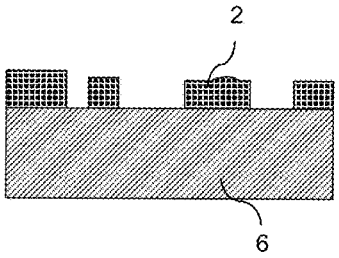
FIG. 2B (PRIOR ART)
Figure 2C:
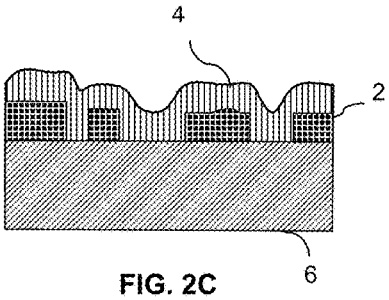
FIG. 2C (PRIOR ART)
Figure 2D:
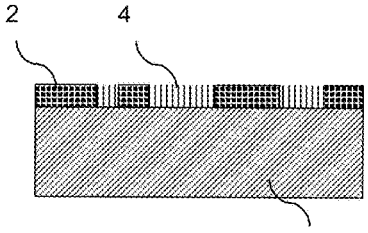
FIG. 2D (PRIOR ART)
Figure 2E:
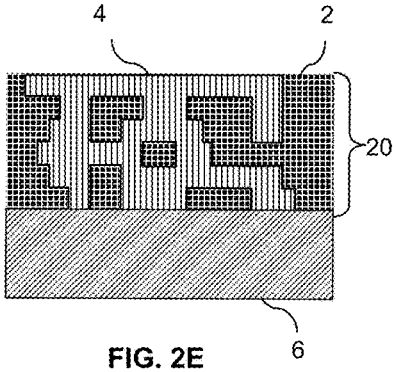
FIG. 2E (PRIOR ART)
Figure 2F:
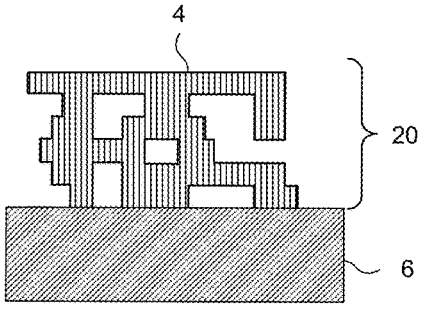
FIG. 2F (PRIOR ART)
Figure 3A:
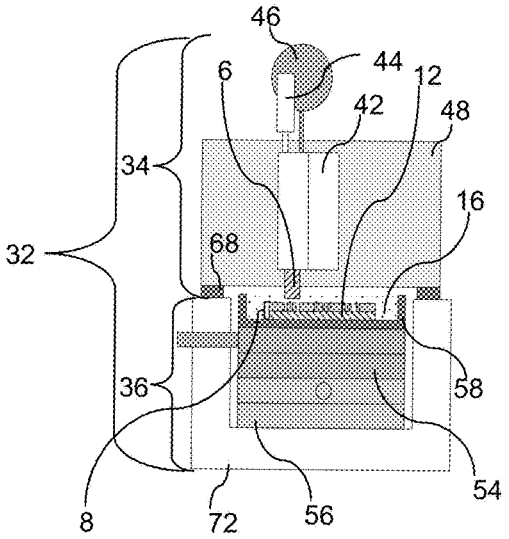
FIG. 3A (PRIOR ART)
FIGS. 3A-3C schematically depict side views of various example subassemblies that may be used in manually implementing the electrochemical fabrication method depicted in FIGS. 2A-2F.
Figure 3B:
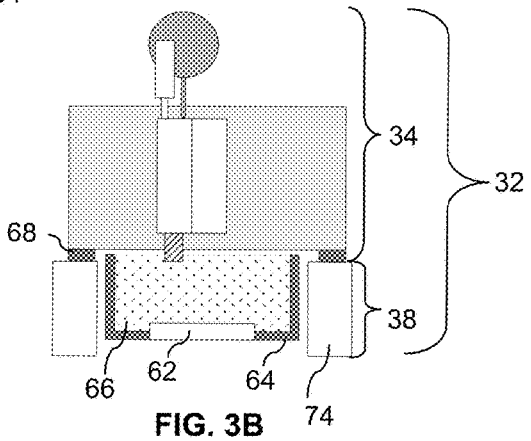
FIG. 3B (PRIOR ART)
Figure 3C:
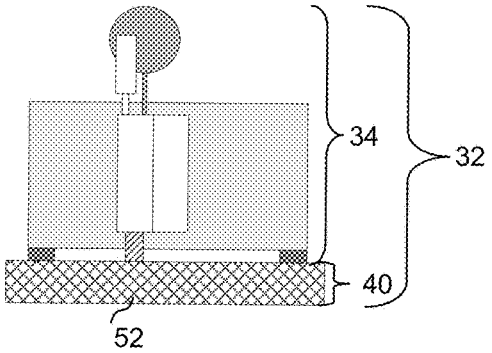
FIG. 3C (PRIOR ART)
Figure 4A:
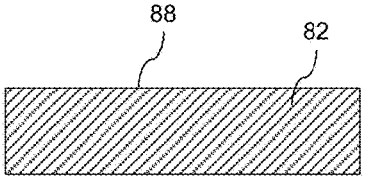
FIG. 4A (PRIOR ART)
FIGS. 4A-4F schematically depict the formation of a first layer of a structure using adhered mask plating where the blanket deposition of a second material overlays both the openings between deposition locations of a first material and the first material itself.
Figure 4B:
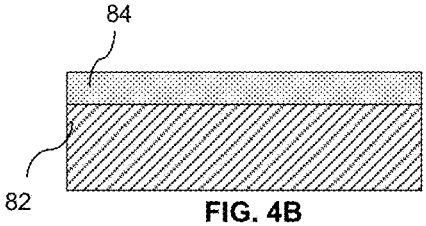
FIG. 4B (PRIOR ART)
Figure 4C:
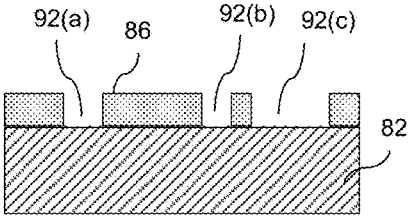
FIG. 4C (PRIOR ART)
Figure 4D:
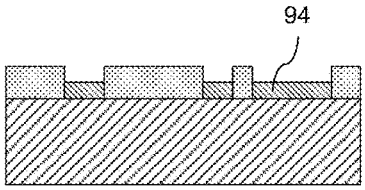
FIG. 4D (PRIOR ART)
Figure 4E:
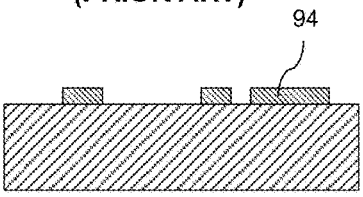
FIG. 4E (PRIOR ART)
Figure 4F:
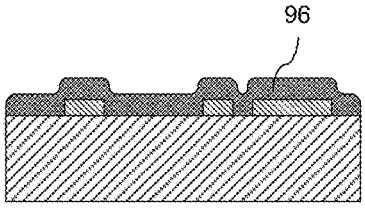
FIG. 4F (PRIOR ART)
Figure 4G:
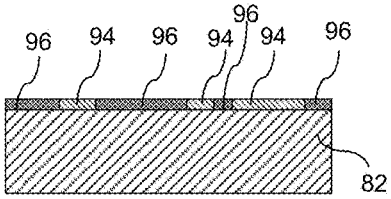
FIG. 4G (PRIOR ART)
FIG. 4G depicts the completion of formation of the first layer resulting from planarizing the deposited materials to a desired level.
Figure 4H:
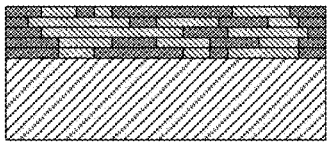
FIG. 4H (PRIOR ART)
FIGS. 4H and 4I respectively depict the state of the process after formation of the multiple layers of the structure and after release of the structure from the sacrificial material.
Figure 4I:
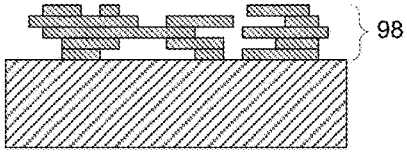
FIG. 4I (PRIOR ART)

FIGS. 4A-4I illustrate side views of various states in an alternative multi-layer, multi-material electrochemical fabrication process. FIGS. 4A-4G illustrate various stages in the formation of a single layer of a multi-layer fabrication process where a second metal is deposited on a first metal as well as in openings in the first metal so that the first and second metal form part of the layer. In FIG. 4A a side view of a substrate 82 having a surface 88 is shown, onto which patternable photoresist 84 is cast as shown in FIG. 4B. In FIG. 4C, a pattern of resist is shown that results from the curing, exposing, and developing of the resist. The patterning of the photoresist 84 results in openings or apertures 92(*a*)-92(*c*) extending from a surface 86 of the photoresist through the thickness of the photoresist to surface 88 of the substrate 82. In FIG. 4D a metal 94 (e.g. nickel) is shown as having been electroplated into the openings 92(*a*)-92(*c*). In FIG. 4E the photoresist has been removed (i.e. chemically stripped) from the substrate to expose regions of the substrate 82 which are not covered with the first metal 94. In FIG. 4F a second metal 96 (e.g. silver) is shown as having been blanket electroplated over the entire exposed portions of the substrate 82 (which is conductive) and over the first metal 94 (which is also conductive). FIG. 4G depicts the completed first layer of the structure which has resulted from the planarization of the first and second metals down to a height that exposes the first metal and sets a thickness for the first layer. In FIG. 4H the result of repeating the process steps shown in FIGS. 4B-4G several times to form a multi-layer structure is shown where each layer consists of two materials. For most applications, one of these materials is removed as shown in FIG. 4I to yield a desired 3-D structure 98 (e.g. component or device).

Various embodiments of various aspects of the invention are directed to formation of three-dimensional structures from materials some, or all, of which may be electrodeposited (as illustrated in FIGS. 1A-4I) or electrolessly deposited. Some of these structures may be formed from a single build level formed from one or more deposited materials while others are formed from a plurality of build layers each including at least two materials (e.g. two or more layers, more preferably five or more layers, and most preferably ten or more layers). In some embodiments, layer thicknesses may be as small as one micron or as large as fifty microns. In other embodiments, thinner layers may be used while in other embodiments, thicker layers may be used. In some embodiments structures having features positioned with micron level precision and minimum features size on the order of tens of microns are to be formed. In some embodiments, overall lateral extents of structures may be as small as 25-100 microns while in other embodiments, much larger structures may be formed. In other embodiments structures with less precise feature placement and/or larger minimum features may be formed. In still other embodiments, higher precision and smaller minimum feature sizes may be desirable. In the present application meso-scale and millimeter-scale have the same meaning and refer to devices that may have one or more dimensions extending into the 0.5-20 millimeter range, or somewhat smaller or larger and with features positioned with precision in the 0.1-10 micron range and with minimum features sizes on the order of 1-100 microns. In some embodiments, layer-to-layer misalignment may be as small as 0.2 microns or finer while in other embodiments, layer-to-layer misalignment may be much larger, such as 1-3 microns for some microscale structures or as large as 10-20 microns, or larger, for some millimeter scale structures.

The various embodiments, alternatives, and techniques disclosed herein may form multi-layer structures using a single patterning technique on all layers or using different patterning techniques on different layers. For example, various embodiments of the invention may perform selective patterning operations using conformable contact masks and masking operations (i.e. operations that use masks which are contacted to but not adhered to a substrate), proximity masks and masking operations (i.e. operations that use masks that at least partially selectively shield a substrate by their proximity to the substrate even if contact is not made), non-conformable masks and masking operations (i.e. masks and operations based on masks whose contact surfaces are not significantly conformable), and/or adhered masks and masking operations (masks and operations that use masks that are adhered to a substrate onto which selective deposition or etching is to occur as opposed to only being contacted to it). Conformable contact masks, proximity masks, and non-conformable contact masks share the property that they are preformed and brought to, or in proximity to, a surface which is to be treated (i.e. the exposed portions of the surface are to be treated). These masks can generally be removed without damaging the mask or the surface that received treatment to which they were contacted, or located in proximity to. Adhered masks are generally formed on the surface to be treated (i.e. the portion of that surface that is to be masked) and bonded to that surface such that they cannot be separated from that surface without being completely destroyed or damaged beyond any point of reuse. Adhered masks may be formed in a number of ways including (1) by application of a photoresist, selective exposure of the photoresist, and then development of the photoresist, (2) selective transfer of pre-patterned masking material, and/or (3) direct formation of masks from computer controlled depositions of material.

Patterning operations may be used in selectively depositing material and/or may be used in the selective etching of material. Selectively etched regions may be selectively filled in or filled in via blanket deposition, or the like, with a different desired material. In some embodiments, the layer-by-layer build up may involve the simultaneous formation of portions of multiple layers. In some embodiments, depositions made in association with some layer levels may result in depositions to regions associated with other layer levels (i.e. regions that lie within the top and bottom boundary levels that define a different layer's geometric configuration). Such use of selective etching and interlaced material deposition in association with multiple layers is described in U.S. patent application Ser. No. 10/434,519, by Smalley, now U.S. Pat. No. 7,252,861, and entitled "Methods of and Apparatus for Electrochemically Fabricating Structures Via Interlaced Layers or Via Selective Etching and Filling of Voids" which is hereby incorporated herein by reference as if set forth in full.

Temporary substrates on which structures may be formed may be of the sacrificial-type (i.e. destroyed or damaged during separation of deposited materials to the extent they cannot be reused), non-sacrificial-type (i.e. not destroyed or excessively damaged, i.e. not damaged to the extent they may not be reused, e.g. with a sacrificial or release layer located between the substrate and the initial layers of a structure that is formed). Non-sacrificial substrates may be considered reusable, with little or no rework (e.g. replanarizing one or more selected surfaces or applying a release layer, and the like) though they may or may not be reused for a variety of reasons.

Definitions

This section of the specification is intended to set forth definitions for a number of specific terms that may be useful in describing the subject matter of the various embodiments of the invention. It is believed that the meanings of most if not all of these terms is clear from their general use in the specification but they are set forth hereinafter to remove any ambiguity that may exist. It is intended that these definitions be used in understanding the scope and limits of any claims that use these specific terms. As far as interpretation of the claims of this patent disclosure are concerned, it is intended that these definitions take presence over any contradictory definitions or allusions found in any materials which are incorporated herein by reference.

"Build" as used herein refers, as a verb, to the process of building a desired structure (or part) or plurality of structures (or parts) from a plurality of applied or deposited materials which are stacked and adhered upon application or deposition or, as a noun, to the physical structure (or part) or structures (or parts) formed from such a process. Depending on the context in which the term is used, such physical structures may include a desired structure embedded within a sacrificial material or may include only desired physical structures which may be separated from one another or may require dicing and/or slicing to cause separation. When a plurality of parts are being formed simultaneously, the process may be termed a batch fabrication process where, for example, the first layer of a plurality of parts is formed, followed by the second layer of the plurality, and continuing with each subsequent layer until all layers of the plurality are formed. In a stacked batch fabrication process, a first group of parts may be formed on a first group of layers after which building of additional layers continues to form a second or subsequent group of parts, and after formation of all groups, sacrificial material may be removed to reveal each part of the various groups of parts.

"Build axis" or "build orientation" is the axis or orientation that is substantially perpendicular to substantially planar levels of deposited or applied materials that are used in building up a structure. The planar levels of deposited or applied materials may be or may not be completely planar but are substantially so in that the overall extent of their cross-sectional dimensions are significantly greater than the height of any individual deposit or application of material (e.g. 100, 500, 1000, 5000, or more times greater). The planar nature of the deposited or applied materials may come about from use of a process that leads to planar deposits or it may result from a planarization process (e.g. a process that includes mechanical abrasion, e.g. lapping, fly cutting, grinding, or the like) that is used to remove material regions of excess height. Unless explicitly noted otherwise, "vertical" as used herein refers to the build axis or nominal build axis (if the layers are not stacking with perfect registration) while "horizontal" or "lateral" refers to a direction within the plane of the layers (i.e. the plane that is substantially perpendicular to the build axis).

"Build layer" or "layer of structure" as used herein does not refer to a deposit of a specific material but instead refers to a region of a build located between a lower boundary level and an upper boundary level which generally defines a single cross-section of a structure being formed or structures which are being formed in parallel. Depending on the details of the actual process used to form the structure, build layers are generally formed on and adhered to previously formed build layers. In some processes the boundaries between build layers are defined by planarization operations which result in successive build layers being formed on substantially planar upper surfaces of previously formed build layers. In some embodiments, the substantially planar upper surface of the preceding build layer may be textured to improve adhesion between the layers. In other build processes, openings may exist in or be formed in the upper surface of a previous but only partially formed build layers such that the openings in the previous build layers are filled with materials deposited in association with current build layers which will cause interlacing of build layers and material deposits. Such interlacing is described in U.S. patent application Ser. No. 10/434,519 now U.S. Pat. No. 7,252,861. This referenced application is incorporated herein by reference as if set forth in full. In most embodiments, a build layer includes at least one primary structural material and at least one primary sacrificial material. However, in some embodiments, two or more primary structural materials may be used without a primary sacrificial material (e.g. when one primary structural material is a dielectric and the other is a conductive material). In some embodiments, build layers are distinguishable from each other by the source of the data that is used to yield patterns of the deposits, applications, and/or etchings of material that form the respective build layers. For example, data descriptive of a structure to be formed which is derived from data extracted from different vertical levels of a data representation of the structure define different build layers of the structure. The vertical separation of successive pairs of such descriptive data may define the thickness of build layers associated with the data. As used herein, at times, "build layer" may be loosely referred simply as "layer". In many embodiments, deposition thickness of primary structural or sacrificial materials (i.e. the thickness of any particular material after it is deposited) is generally greater than the layer thickness and a net deposit thickness is set via one or more planarization processes which may include, for example, mechanical abrasion (e.g. lapping, fly cutting, polishing, and the like) and/or chemical etching (e.g. using selective or non-selective etchants). The lower boundary and upper boundary for a build layer may be set and defined in different ways. From a design point of view they may be set based on a desired vertical resolution of the structure (which may vary with height). From a data manipulation point of view, the vertical layer boundaries may be defined as the vertical levels at which data descriptive of the structure is processed or the layer thickness may be defined as the height separating successive levels of cross-sectional data that dictate how the structure will be formed. From a fabrication point of view, depending on the exact fabrication process used, the upper and lower layer boundaries may be defined in a variety of different ways. For example by planarization levels or effective planarization levels (e.g. lapping levels, fly cutting levels, chemical mechanical polishing levels, mechanical polishing levels, vertical positions of structural and/or sacrificial materials after relatively uniform etch back following a mechanical or chemical mechanical planarization process). For example, by levels at which process steps or operations are repeated. At levels at which, at least theoretically, lateral extends of structural material can be changed to define new cross-sectional features of a structure. Even though in many embodiments, vertical sidewalls of layers are desired, it is not the case in all embodiments and some amount of upward sloping or downward sloping sidewall featuring may exist as a result of process limitations or by process design. Such features may provide evidence of layer boundaries, layer stacking, and even layer planarization in formed structures. Such features may provide layer-to-layer wall surface variations along the thickness of a layer on the order of a fraction of a micron to several microns or more depending on the layer thickness and process details involved.

"Layer thickness" is the height along the build axis between a lower boundary of a build layer and an upper boundary of that build layer.

"Planarization" is a process that tends to remove materials, above a desired plane, in a substantially non-selective manner such that all deposited materials are brought to a substantially common height or desired level (e.g. within 20%, 10%, 5%, or even 1% of a desired layer boundary level). For example, lapping removes material in a substantially non-selective manner though some amount of recession of one material or another may occur (e.g. copper may recess relative to nickel). Planarization may occur primarily via mechanical means, e.g. lapping, grinding, fly cutting, milling, sanding, abrasive polishing, frictionally induced melting, other machining operations, or the like (i.e. mechanical planarization). Mechanical planarization may be followed or preceded by thermally induced planarization (e.g. melting) or chemically induced planarization (e.g. etching). Planarization may occur primarily via a chemical and/or electrical means (e.g. chemical etching, electrochemical etching, or the like). Planarization may occur via a simultaneous combination of mechanical and chemical etching (e.g. chemical mechanical polishing (CMP)).

"Structural material" as used herein refers to a material that remains part of the structure when put into use.

"Supplemental structural material" as used herein refers to a material that forms part of the structure when the structure is put to use but is not added as part of the build layers but instead is added to a plurality of layers simultaneously (e.g. via one or more coating operations that applies the material, selectively or in a blanket fashion, to one or more surfaces of a desired build structure that has been released from a sacrificial material.

"Primary structural material" as used herein is a structural material that forms part of a given build layer and which is typically deposited or applied during the formation of that build layer and which makes up more than 20% of the structural material volume of the given build layer. In some embodiments, the primary structural material may be the same on each of a plurality of build layers or it may be different on different build layers. In some embodiments, a given primary structural material may be formed from two or more materials by the alloying or diffusion of two or more materials to form a single material.

"Secondary structural material" as used herein is a structural material that forms part of a given build layer and is typically deposited or applied during the formation of the given build layer but is not a primary structural material as it individually accounts for only a small volume of the structural material associated with the given layer. A secondary structural material will account for less than 20% of the volume of the structural material associated with the given layer. In some preferred embodiments, each secondary structural material may account for less than 10%, 5%, or even 2% of the volume of the structural material associated with the given layer. Examples of secondary structural materials may include seed layer materials, adhesion layer materials, barrier layer materials (e.g. diffusion barrier material), and the like. These secondary structural materials are typically applied to form coatings having thicknesses less than 2 microns, 1 micron, 0.5 microns, or even 0.2 microns. The coatings may be applied in a conformal or directional manner (e.g. via CVD, PVD, electroless deposition, or the like). Such coatings may be applied in a blanket manner or in a selective manner. Such coatings may be applied in a planar manner (e.g. over previously planarized layers of material) as taught in U.S. patent application Ser. No. 10/607,931, now U.S. Pat. No. 7,239,219. In other embodiments, such coatings may be applied in a non-planar manner, for example, in openings in and over a patterned masking material that has been applied to previously planarized layers of material as taught in U.S. patent application Ser. No. 10/841,383, now U.S. Pat. No. 7,195,989. These referenced applications are incorporated herein by reference as if set forth in full herein.

"Functional structural material" as used herein is a structural material that would have been removed as a sacrificial material but for its actual or effective encapsulation by other structural materials. Effective encapsulation refers, for example, to the inability of an etchant to attack the functional structural material due to inaccessibility that results from a very small area of exposure and/or due to an elongated or tortuous exposure path. For example, large (10,000 $\mu m^2$) but thin (e.g. less than 0.5 microns) regions of sacrificial copper sandwiched between deposits of nickel may define regions of functional structural material depending on ability of a release etchant to remove the sandwiched copper.

"Sacrificial material" is material that forms part of a build layer but is not a structural material. Sacrificial material on a given build layer is separated from structural material on that build layer after formation of that build layer is completed and more generally is removed from a plurality of layers after completion of the formation of the plurality of layers during a "release" process that removes the bulk of the sacrificial material or materials. In general sacrificial material is located on a build layer during the formation of one, two, or more subsequent build layers and is thereafter removed in a manner that does not lead to a planarized surface. Materials that are applied primarily for masking purposes, i.e. to allow subsequent selective deposition or etching of a material, e.g. photoresist that is used in forming a build layer but does not form part of the build layer) or that exist as part of a build for less than one or two complete build layer formation cycles are not considered sacrificial materials as the term is used herein but instead shall be referred as masking materials or as temporary materials. These separation processes are sometimes referred to as a release process and may or may not involve the separation of structural material from a build substrate. In many embodiments, sacrificial material within a given build layer is not removed until all build layers making up the three-dimensional structure have been formed. Of course sacrificial material may be, and typically is, removed from above the upper level of a current build layer during planarization operations during the formation of the current build layer. Sacrificial material is typically removed via a chemical etching operation but in some embodiments may be removed via a melting operation or electrochemical etching operation. In typical structures, the removal of the sacrificial material (i.e. release of the structural material from the sacrificial material) does not result in planarized surfaces but instead results in surfaces that are dictated by the boundaries of structural materials located on each build layer. Sacrificial materials are typically distinct from structural materials by having different properties therefrom (e.g. chemical etchability, hardness, melting point, etc.) but in some cases, as noted previously, what would have been a sacrificial material may become a structural material by its actual or effective encapsulation by other structural materials. Similarly, structural materials may be used to form sacrificial structures that are separated from a desired structure during a release process via the sacrificial structures being only attached to sacrificial material or potentially by dissolution of the sacrificial structures themselves using a process that is insufficient to reach structural material that is intended to form part of a desired structure. It should be understood that in some embodiments, small amounts of structural material may be removed, after or during release of sacrificial material. Such small amounts of structural material may have been inadvertently formed due to imperfections in the fabrication process or may result from the proper application of the process but may result in features that are less than optimal (e.g. layers with stairs steps in regions where smooth sloped surfaces are desired. In such cases the volume of structural material removed is typically minuscule compared to the amount that is retained and thus such removal is ignored when labeling materials as sacrificial or structural. Sacrificial materials are typically removed by a dissolution process, or the like, that destroys the geometric configuration of the sacrificial material as it existed on the build layers. In many embodiments, the sacrificial material is a conductive material such as a metal. As will be discussed hereafter, masking materials though typically sacrificial in nature are not termed sacrificial materials herein unless they meet the required definition of sacrificial material.

"Supplemental sacrificial material" as used herein refers to a material that does not form part of the structure when the structure is put to use and is not added as part of the build layers but instead is added to a plurality of layers simultaneously (e.g. via one or more coating operations that applies the material, selectively or in a blanket fashion, to a one or more surfaces of a desired build structure that has been released from an initial sacrificial material. This supplemental sacrificial material will remain in place for a period of time and/or during the performance of certain post layer formation operations, e.g. to protect the structure that was released from a primary sacrificial material, but will be removed prior to putting the structure to use.

"Primary sacrificial material" as used herein is a sacrificial material that is located on a given build layer and which is typically deposited or applied during the formation of that build layer and which makes up more than 20% of the sacrificial material volume of the given build layer. In some embodiments, the primary sacrificial material may be the same on each of a plurality of build layers or may be different on different build layers. In some embodiments, a given primary sacrificial material may be formed from two or more materials by the alloying or diffusion of two or more materials to form a single material.

"Secondary sacrificial material" as used herein is a sacrificial material that is located on a given build layer and is typically deposited or applied during the formation of the build layer but is not a primary sacrificial materials as it individually accounts for only a small volume of the sacrificial material associated with the given layer. A secondary sacrificial material will account for less than 20% of the volume of the sacrificial material associated with the given layer. In some preferred embodiments, each secondary sacrificial material may account for less than 10%, 5%, or even 2% of the volume of the sacrificial material associated with the given layer. Examples of secondary structural materials may include seed layer materials, adhesion layer materials, barrier layer materials (e.g. diffusion barrier material), and the like. These secondary sacrificial materials are typically applied to form coatings having thicknesses less than 2 microns, 1 micron, 0.5 microns, or even 0.2 microns). The coatings may be applied in a conformal or directional manner (e.g. via CVD, PVD, electroless deposition, or the like). Such coatings may be applied in a blanket manner or in a selective manner. Such coatings may be applied in a planar manner (e.g. over previously planarized layers of material) as taught in U.S. patent application Ser. No. 10/607,931, now U.S. Pat. No. 7,239,219. In other embodiments, such coatings may be applied in a non-planar manner, for example, in openings in and over a patterned masking material that has been applied to previously planarized layers of material as taught in U.S. patent application Ser. No. 10/841,383, now U.S. Pat. No. 7,195,989. These referenced applications are incorporated herein by reference as if set forth in full herein.

"Adhesion layer", "seed layer", "barrier layer", and the like refer to coatings of material that are thin in comparison to the layer thickness and thus generally form secondary structural material portions or sacrificial material portions of some layers. Such coatings may be applied uniformly over a previously formed build layer, they may be applied over a portion of a previously formed build layer and over patterned structural or sacrificial material existing on a current (i.e. partially formed) build layer so that a non-planar seed layer results, or they may be selectively applied to only certain locations on a previously formed build layer. In the event such coatings are non-selectively applied, selected portions may be removed (1) prior to depositing either a sacrificial material or structural material as part of a current layer or (2) prior to beginning formation of the next layer or they may remain in place through the layer build up process and then etched away after formation of a plurality of build layers.

"Masking material" is a material that may be used as a tool in the process of forming a build layer but does not form part of that build layer. Masking material is typically a photopolymer or photoresist material or other material that may be readily patterned. Masking material is typically a dielectric. Masking material, though typically sacrificial in nature, is not a sacrificial material as the term is used herein. Masking material is typically applied to a surface during the formation of a build layer for the purpose of allowing selective deposition, etching, or other treatment and is removed either during the process of forming that build layer or immediately after the formation of that build layer.

"Multilayer structures" are structures formed from multiple build layers of deposited or applied materials.

"Multilayer three-dimensional (or 3D or 3-D) structures" are Multilayer Structures that meet at least one of two criteria: (1) the structural material portion of at least two layers of which one has structural material portions that do not overlap structural material portions of the other.

"Complex multilayer three-dimensional (or 3D or 3-D) structures" are multilayer three-dimensional structures formed from at least three layers where a line may be defined that hypothetically extends vertically through at least some portion of the build layers of the structure will extend from structural material through sacrificial material and back through structural material or will extend from sacrificial material through structural material and back through sacrificial material (these might be termed vertically complex multilayer three-dimensional structures). Alternatively, complex multilayer three-dimensional structures may be defined as multilayer three-dimensional structures formed from at least two layers where a line may be defined that hypothetically extends horizontally through at least some portion of a build layer of the structure that will extend from structural material through sacrificial material and back through structural material or will extend from sacrificial material through structural material and back through sacrificial material (these might be termed horizontally complex multilayer three-dimensional structures). Worded another way, in complex multilayer three-dimensional structures, a vertically or horizontally extending hypothetical line will extend from one or structural material or void (when the sacrificial material is removed) to the other of void or structural material and then back to structural material or void as the line is traversed along at least a portion of the line.

"Moderately complex multilayer three-dimensional (or 3D or 3-D) structures are complex multilayer 3D structures for which the alternating of void and structure or structure and void not only exists along one of a vertically or horizontally extending line but along lines extending both vertically and horizontally.

"Highly complex multilayer (or 3D or 3-D) structures are complex multilayer 3D structures for which the structure-to-void-to-structure or void-to-structure-to-void alternating occurs once along the line but occurs a plurality of times along a definable horizontally or vertically extending line.

"Up-facing feature" is an element dictated by the cross-sectional data for a given build layer "n" and a next build layer "n+1" that is to be formed from a given material that exists on the build layer "n" but does not exist on the immediately succeeding build layer "n+1". For convenience the term "up-facing feature" will apply to such features regardless of the build orientation.

"Down-facing feature" is an element dictated by the cross-sectional data for a given build layer "n" and a preceding build layer "n−1" that is to be formed from a given material that exists on build layer "n" but does not exist on the immediately preceding build layer "n−1". As with up-facing features, the term "down-facing feature" shall apply to such features regardless of the actual build orientation.

"Continuing region" is the portion of a given build layer "n" that is dictated by the cross-sectional data for the given build layer "n", a next build layer "n+1" and a preceding build layer "n−1" that is neither up-facing nor down-facing for the build layer "n".

"Minimum feature size" or "MFS" refers to a necessary or desirable spacing between structural material elements on a given layer that are to remain distinct in the final device configuration. If the minimum feature size is not maintained for structural material elements on a given layer, the fabrication process may result in structural material inadvertently bridging what were intended to be two distinct elements (e.g. due to masking material failure or failure to appropriately fill voids with sacrificial material during formation of the given layer such that during formation of a subsequent layer structural material inadvertently fills the void). More care during fabrication can lead to a reduction in minimum feature size. Alternatively, a willingness to accept greater losses in productivity (i.e. lower yields) can result in a decrease in the minimum feature size. However, during fabrication for a given set of process parameters, inspection diligence, and yield (successful level of production) a minimum design feature size is set in one way or another. The above described minimum feature size may more appropriately be termed minimum feature size of gaps or voids (e.g. the MFS for sacrificial material regions when sacrificial material is deposited first). Conversely a minimum feature size for structure material regions (minimum width or length of structural material elements) may be specified. Depending on the fabrication method and order of deposition of structural material and sacrificial material, the two types of minimum feature sizes may be the same or different. In practice, for example, using electrochemical fabrication methods as described herein, the minimum features size on a given layer may be roughly set to a value that approximates the layer thickness used to form the layer and it may be considered the same for both structural and sacrificial material widths. In some more rigorously implemented processes (e.g. with higher examination regiments and tolerance for rework), it may be set to an amount that is 80%, 50%, or even 30% of the layer thickness. Other values or methods of setting minimum feature sizes may be used. Worded another way, depending on the geometry of a structure, or plurality of structures, being formed, the structure, or structures, may include elements (e.g. solid regions) which have dimensions smaller than a first minimum feature size and/or have spacings, voids, openings, or gaps (e.g. hollow or empty regions) located between elements, where the spacings are smaller than a second minimum feature size where the first and second minimum feature sizes may be the same or different and where the minimum feature sizes represent lower limits at which formation of elements and/or spacing can be reliably formed. Reliable formation refers to the ability to accurately form or produce a given geometry of an element, or of the spacing between elements, using a given formation process, with a minimum acceptable yield. The minimum acceptable yield may depend on a number of factors including: (1) number of features present per layer, (2) numbers of layers, (3) the criticality of the successful formation of each feature, (4) the number and severity of other factors effecting overall yield, and (5) the desired or required overall yield for the structures or devices themselves. In some circumstances, the minimum size may be determined by a yield requirement per feature which is as low as 70%, 60%, or even 50%. While in other circumstances the yield requirement per feature may be as high as 90%, 95%, 99%, or even higher. In some circumstances (e.g. in producing a filter element) the failure to produce a certain number of desired features (e.g. 20-40% failure may be acceptable while in an electrostatic actuator the failure to produce a single small space between two moveable electrodes may result in failure of the entire device. The MFS, for example, may be defined as the minimum width of a narrow and processing element (e.g. photoresist element or sacrificial material element) or structural element (e.g. structural material element) that may be reliably formed (e.g. 90-99.9 times out of 100) which is either independent of any wider structures or has a substantial independent length (e.g. 200-1000 microns) before connecting to a wider region.

"Sublayer" as used herein refers to a portion of a build layer that typically includes the full lateral extents of that build layer but only a portion of its height. A sublayer is usually a vertical portion of build layer that undergoes independent processing compared to another sublayer of that build layer.

"Device(s)", "part(s)", component(s)", and "structure(s)" as used herein generally have the same meaning unless a distinction is required by the context in which the terms are used and generally refer to a single layer or multi-layer configuration of one or more structural materials having a desired design or shape, sometimes a design or shape originally set forth in a 3D CAD model or the like. In some contexts, such terms may refer to the actual design (e.g. CAD design) as opposed to a physical structure itself.

Figure 5A:
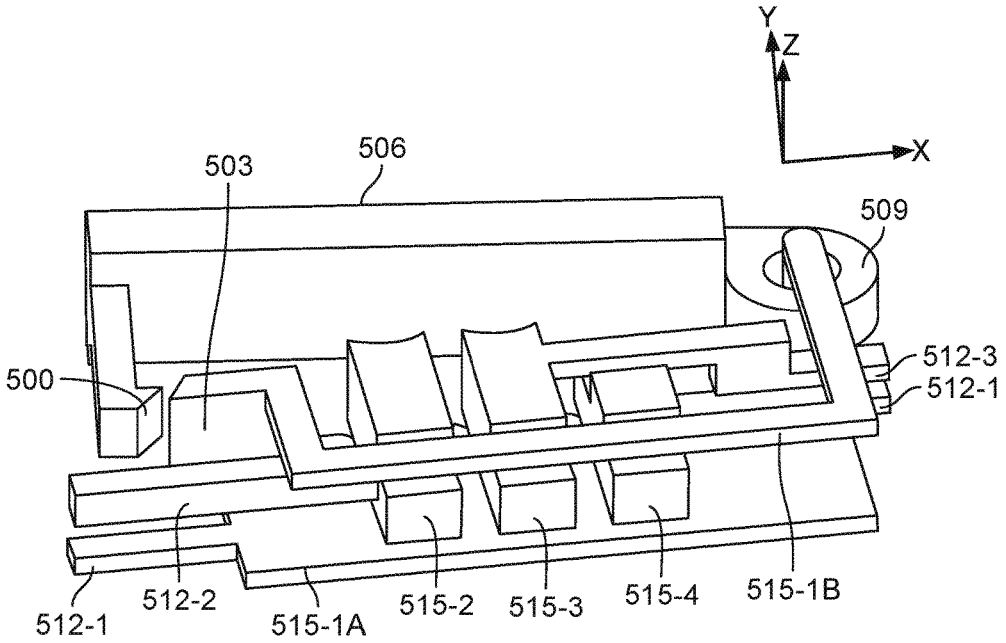
FIGS. 5A-5B depict two different perspective views an example connector according to a first embodiment of the invention wherein the connector comprises four electrically isolated IDC type connectors with each including a seat for engaging a dielectric coating of a wire, a spike for making electrical connection with a wire of a ribbon cable and a lead for making contact with a displaced terminal in the event that the individual terminal mounting locations on a board for the each connector base do not exist.
Figure 5B:
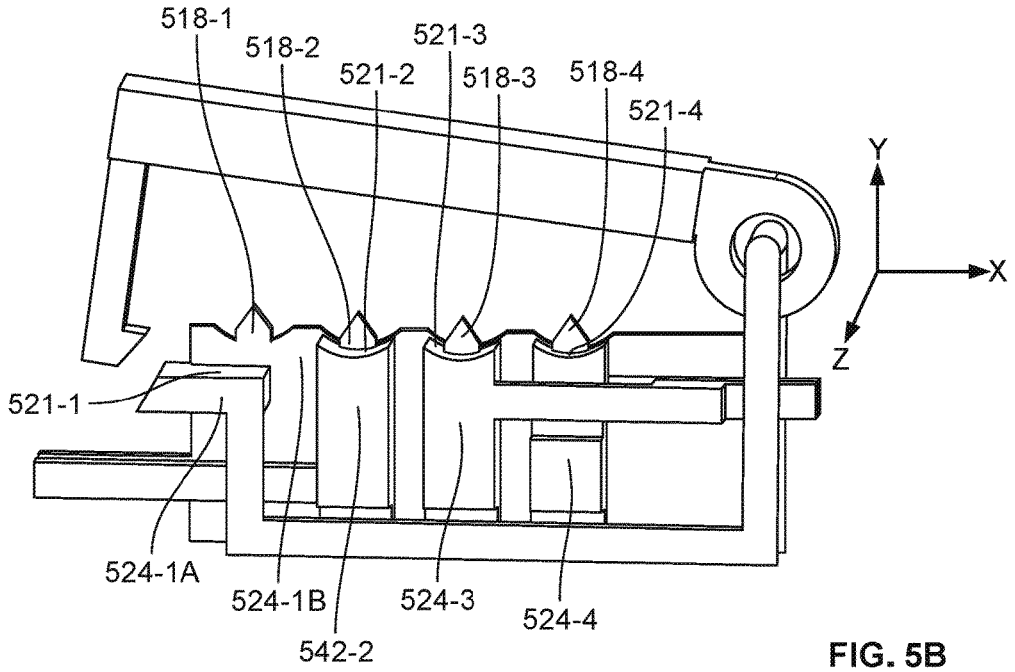

Connectors:

FIGS. 5A-5B depict two different perspective views an example connector according to a first embodiment of the invention wherein the connector comprises four electrically isolated IDC type connectors with each including a seat 521-1 to 521-4, which may be flat such as 521-1A or rounded like 521-2 to 521-4 to help guide the wire to a desired seating position. The seats are located at the distal end of standoffs 524-1 to 524-4 for engaging a dielectric coating of a wire, a spike 518-1 to 518-4 for making electrical connection with a wire of a ribbon cable and a lead 512-1 to 512-4 for making contact with a displaced terminal in the event that the individual terminal mounting locations on a board for the each connector base do not exist. The connector further includes a rotatable bar or arm 506 for compressing the wire onto its spike and seat and for clamping the wires and connector together. Some connectors are formed in a batch process from a plurality adhered multi-material layers each layer simultaneously formed and adhered to a previously formed layer while stacking along the Z axis. In some embodiments the connectors may be mounted to the board via solder, a dielectric adhesive or inserted into a dielectric socket that was pre-mounted to the board. In some implementations mounting for each individual connector may occur to a base element 515-1A & 515-1B, 515-2, 515-3, and 515-4 that is located in the X-Z plane with the second to forth contactors (from left to right) mounted via pedestals or post like standoffs 524-2 to 424-4 and the first mounted via two separated elongated elements 524-1A and 524-1B that also engage a pivot ring 509 for the latch arm and a pivot seat 503 where upon closure the latch arm engages the mounted base via latch hook 500 and latch seat 503 near the first contact element. In this mounting configuration the ribbon cable will be run substantially parallel to the surface of the board in its mounting position. In some other implementations the connector may be mounted to the board via its front face (as defined by elements 524-1A, 524-2, 524-3, and 524-4) as opposed to its bottom surface as defined by 515-1A, 515-1B, 515-2, 515-3, and 515-4. where the arm would swing open and closed parallel to the surface of the board either over the board itself or by overhanging an end of the board in which case the ribbon cable would be oriented perpendicularly to the board surface in its mounting location. In other alternatives, contact seats, the spikes, and the latch may be provided in a manner to allow different ribbon cable to board orientations.

Figure 5C:
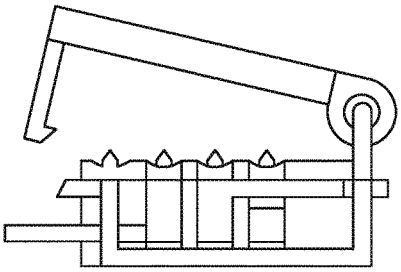
FIGS. 5C and 5D, respectively, provide a front view and a back view of the connector of FIGS. 5A-5B.
Figure 5D:
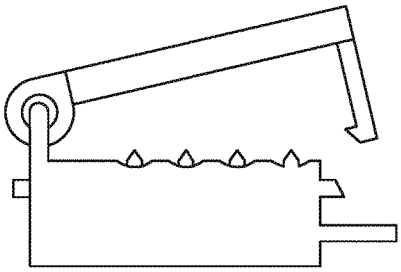
Figure 5E:
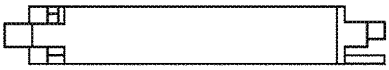
FIGS. 5E and 5F, respectively, provide a top view and a bottom view of the connector of FIGS. 5A-5B.
Figure 5F:
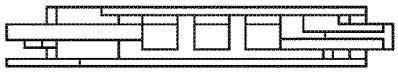
Figure 5G:
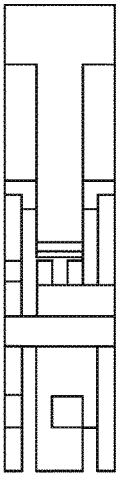
FIGS. 5G and 5H, respectively, provide left and right end views of the connector of FIGS. 5A-5B.
Figure 5H:
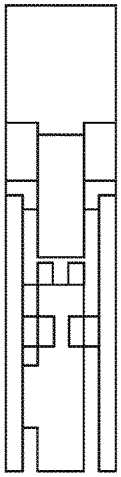

FIGS. 5C-5H provide various additional views of the connector of 5A-5B. FIGS. 5C and 5D respectively provide a front view and a back view of the connector. FIGS. 5E and 5F respectively provide a top view and a bottom view of the connector. FIGS. 5G and 5H respectively provide left and right end views of the connector. From FIGS. 5E-5H it can be seen that the connector can be formed with 7 distinct layers if formed with layers lay parallel to the front and back sides of the connector. Of course each of these layers may be divided into multiple layers if desired or additional features may be added with the possibility of increasing layer count. In other alternatives, it may be possible to reduce the layer count still further.

Figure 6:
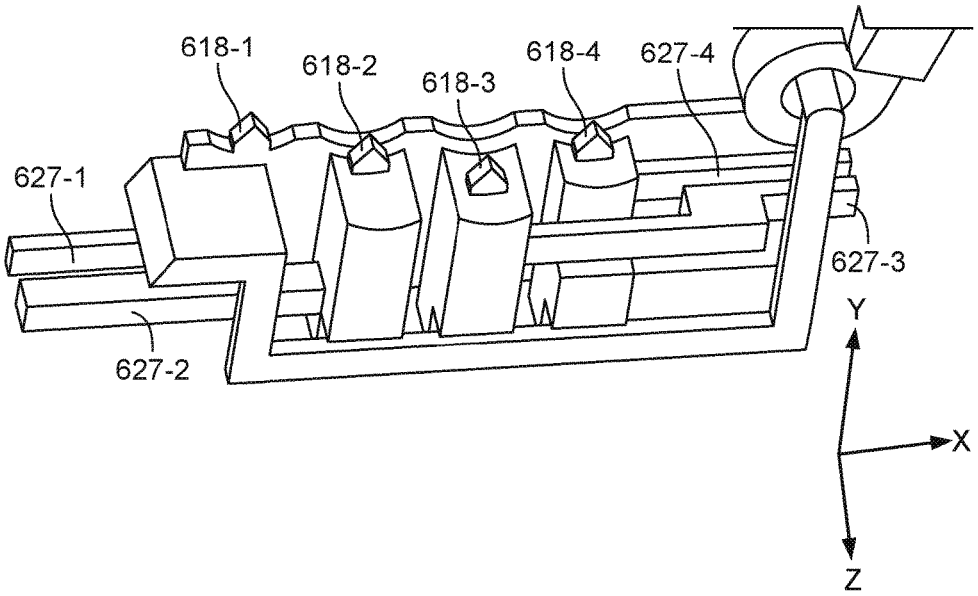

FIG. 6 provides a perspective view of the top of the connector (with the latch removed) so that the individual contactor spikes may be better seen with the spike identifiers incremented to the 600 series of reference numbers 618-1 to 618-4 and with the lead extensions 627-1 to 627-4 labeled to show that alternative signal paths that may be provided from spikes/seats/posts to alternative connection points.

Figure 7:
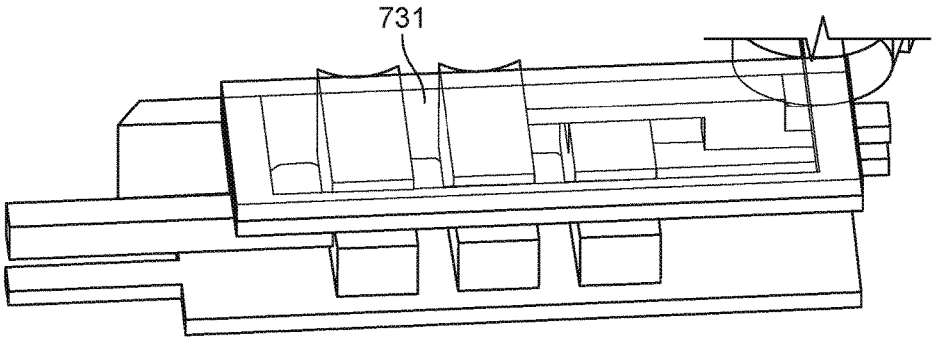

FIG. 7 depicts an embodiment of the device that includes an additional material 713 for holding the individual leads and contactors in position at least until board mounting has occurred. If the additional material is to be permanent it must be a dielectric material or at least include appropriately located dielectric materials to ensure electrical isolation of the leads and contacts. If the additional material is temporary, it may be a conductive material (e.g. the sacrificial material that is used in forming the connectors in some embodiments). The additional material may be formed as part of one or more of the layers that are used in building up the connectors or alternatively may be an added layer or a material that is added after layer formation is completed. The dielectric material may be parylene, some other plastic, a ceramic material or may even be a photoresist material such as that used in forming the device in some fabrication embodiments.

Figure 8A:
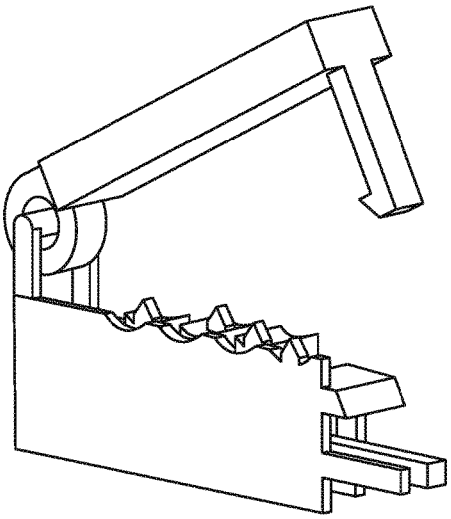
FIGS. 8A-8C illustrate three steps in using the connector to make contact with various wires of a ribbon cable.
Figure 8B:
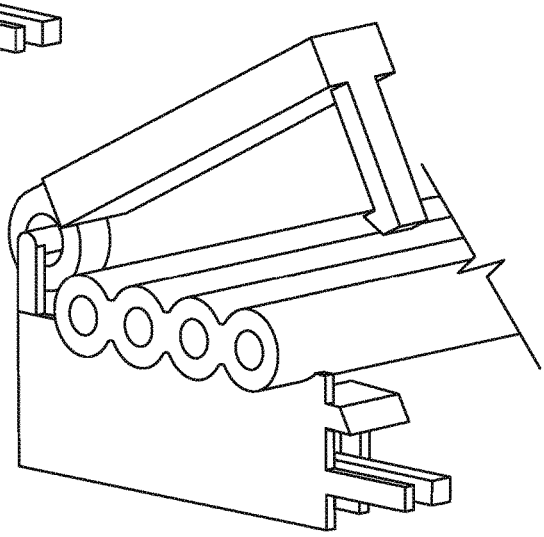
Figure 8C:
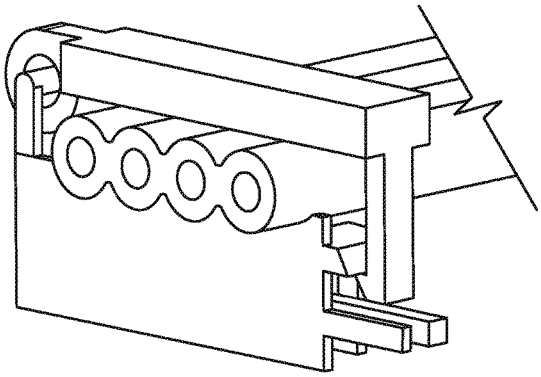

FIGS. 8A-8C illustrate three steps that are involved in using the sample connector of FIGS. 5A-5B to make contact with various wires of a ribbon cable. In FIG. 8A, the connector is shown with the latch open. In FIG. 8B, the connector is shown with the 4 wire ribbon cable inserted into the connector. In FIG. 8C the latch is shown as closed with the latch hook engaging the latch seat and with the spikes penetrating the dielectric coating around the wires to make the desired electrical contact.

Figure 9A:
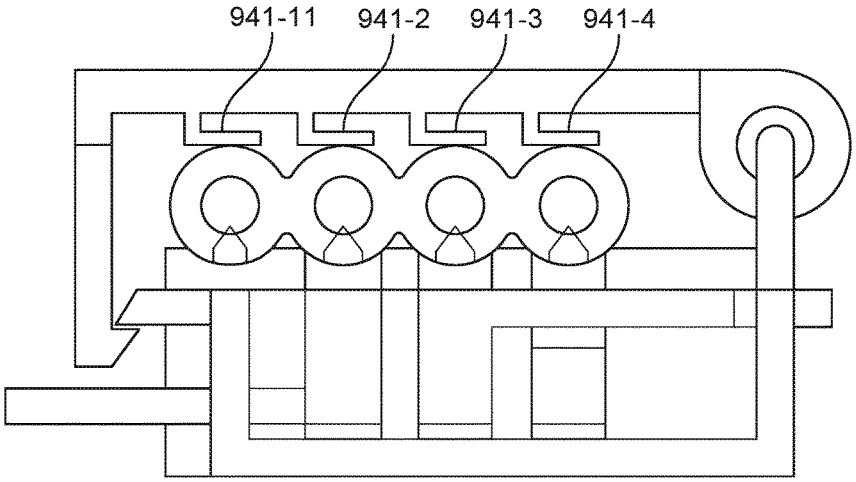
Figure 9B:
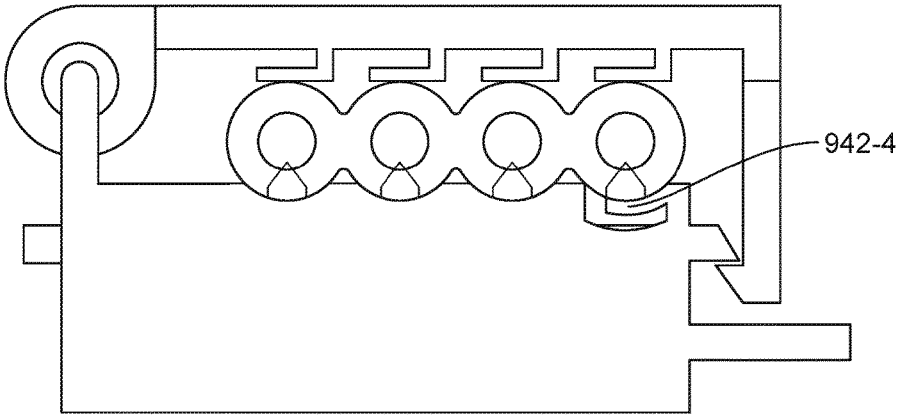
FIG. 9B illustrates a second example where a plurality of compliant members engage each wire on the opposite side from the spikes but also where a compliant member supports the right most spike.

In some alternative embodiments, the latch arm may include one or more compliant regions that provide compliance for individually engaging each wire or groups of wires. FIG. 9A illustrates front view of an example of a connector having compliant members 941-1 to 941-4 on the latch arm that engage each wire. In some alternative embodiments, compliance may be supplied on the spike posts either in addition to that provided on the latch arm or as an alternative thereto. FIG. 9B illustrate a back view of the example connector again having a plurality of compliant members on the latch arm engaging the wires from above while also showing a compliant member 942-4 supporting right most spike. In other embodiments, the compliant members may take other forms including other cantilevers, bridges supported on two sides, s-shaped springs, coiled springs, structures with compressible backing material, torsional elements, and the like.

Figure 10:
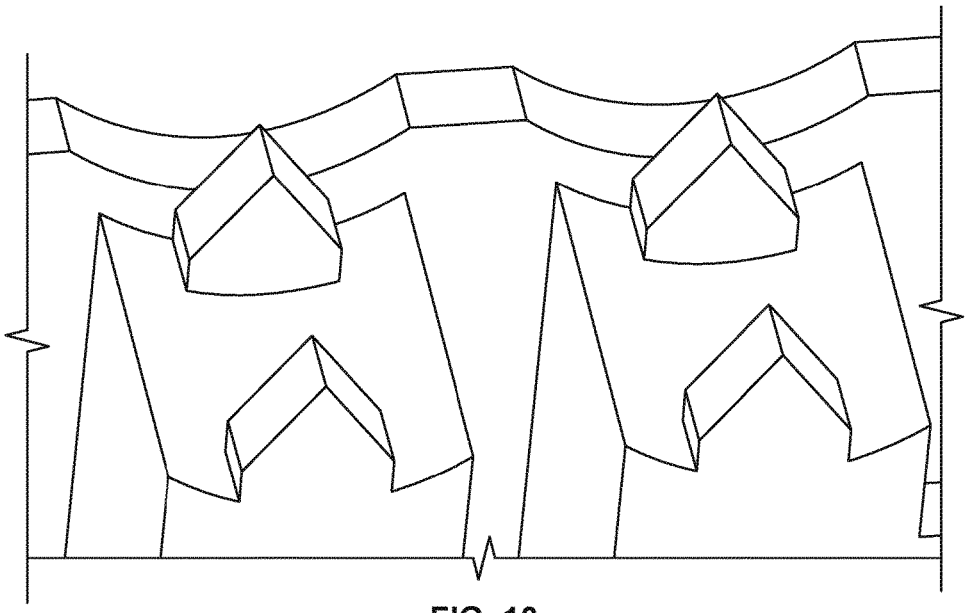

In some embodiments, each individual wire contactor may comprise more than one spike. The spikes may be offset from one another radially relative to the wire and thus may not contact the center of an individual wire but may engage with the sides of the wires (e.g. one or more spikes on each side of a wire. In other multi-spike alternatives, the spikes may be axially spaced and/or both axially and radially spaced. In some such embodiments, two spikes may be provided while in others, more than two spikes may be provided per wire. In some embodiments different numbers of spikes may be supplied on different wires (e.g. depending on anticipated current load each wire). A multi-spike example is shown in FIG. 10 where a perspective view of a couple of wire seats are shown with each having two spikes arranged axially such that they both encounter the wire near its center line. In some alternative embodiments, the spikes themselves may be formed from multiple layers where spike elements on different layer have different lengths. In some embodiments the spikes may be formed with tips oriented axially (i.e. along the length of the wire) instead of laterally (i.e. in a direction per perpendicular to the length of the wire as in the depicted example.

In some further variations of the embodiments of FIGS. 5A-10, a larger number of wires may be accommodated by the connectors so that ribbons cables having larger numbers of wires may be handled in a more compact manner while in other embodiments fewer numbers of contactors may be provided in a given connector. In some embodiments the connectors may be releasable while in others they may be single use connectors. In some embodiments, after connections are made the wires and connector may be covered in a protective dielectric material. In some embodiments, connectors may be formed with as few as five layers, and possibly fewer layers, while in other embodiments more than five 5 layers may be used. In the example of FIGS. 5A-5B, six or seven layers are used though use of more layers is possible. In some embodiments the spikes for each contactor may all be located within a single line while in other embodiments, such as that of FIGS. 5A-10, the spikes may be located along more than one line). In some embodiments, curved seats for holding the wires in place may be eliminated, while in other embodiments they may be located on the latch arm, while in still other embodiments they may be located on both the latch arm and on the contact pedestals. In some embodiments spikes may be formed with asymmetric configurations to aid the spike in penetrating coatings. In some embodiment, the connector may include a stop feature that position the wires of the ribbon from in optimal locations during attachment.

In some embodiments of the invention, the connector may be used to engage ribbon cable with wires as large as 28 AWG while in other embodiments the connectors may be configured to engage wire in the 30-40 gauge range or possibly even finer wire. In some embodiments, the connectors may engage pre-stripped or bare wire particularly where multiple spikes are used for each wire or other features exist to aid in retention and alignment. In some embodiments an entire 4 wire connector may be as small as 0.10-1.0 mm in Z, the layer stacking direction (e.g. 0.5 mm or 0.25 mm), 0.5-2 mm in Y (e.g. a height of 1.0 mm) and 0.5-4.0 mm in X (e.g. a length or 1.5 mm or 2.0 mm). Of course the length in X will vary with the number of connector that are being engaged. In some embodiments the width of individual contacts may approximate the width of the individual coated wires that are being connected. In some embodiments, the width of individual contactors may be smaller than the individual coated wires by 5-50 microns while the gap between individual contacts elements is in that same range. In some embodiments the thickness of the individual layers may be 2-50 microns while in other embodiments they may be thicker or thinner. In some embodiments tips may be formed with a shell of rhodium or other hard and noble metal backed by a core of a strong but less brittle metal like NiCo or NiP. It will be understood by those of skill in the art, that in other embodiments, connectors may be outside the ranges set forth above.

In some embodiments the entire connector is made from a multi-layer multi-material electrochemical fabrication process without need for any secondary processing. In some embodiments, a solder or other bonding material may be added to the connector during layer fabrication, while in other embodiments, adhesion promoting materials (e.g. gold, titanium, chromium, or the like) be formed as part of the device to aid in bonding or even flow barrier materials (e.g. lacquers, tungsten, and the like) may incorporated to help minimize risk of inadvertent flow of solder into certain locations. In some embodiments, sacrificial material may be removed prior to, or after, transfer to a PCB or other mounting board. In some embodiments the spikes extend above their respective seats only slightly above a length necessary to penetrate any dielectric wire coating while in other embodiments the spikes may extend up to ½ the wire diameter or more beyond the length necessary to penetrate the insulator depending on where and how the spike is to engage the wire (e.g. into the middle of the wire or on the side of the wire). In some embodiments, the connectors may be used without necessity of using any dielectric to keep the individual leads or contacts electrically isolated. In some embodiments, the connectors need not be used for ribbon cables but may be used as single wire connectors. In some embodiments, the multi-layer fabrication process may not transfer the connectors to a separate substrate may incorporate a portion of the their fabrication substrate as a bonding surface or even remain attached to their fabrication substrate which may function as a micro circuit board (see U.S. patent application Ser. No. 15/167,899, entitled "Solderless Microcircuit Boards, Components, Methods of Making, and Methods of Using" which is incorporated herein by this reference as if set forth in full).

In some alternative embodiments, various materials may be used in the connector at different locations to provide enhanced connector properties. Some materials may be used for strength and resilience, others may be used for contact properties, others may be used for enhanced conductivity, others may be used for dielectric properties, while still others may be used as temporary sacrificial materials. For example, NiCo or NiP may be used as a strong resilient material while rhodium may be used as a hard and noble contact material, copper may be used as a conductivity enhancer and/or as a sacrificial material, while parylene or some other polymer or ceramic may be used as a dielectric.

Figure 11A:
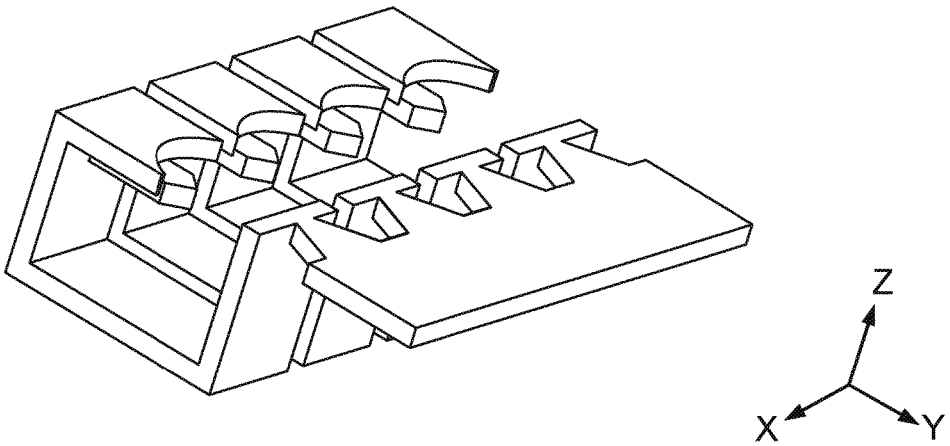
FIGS. 11A-11C A illustrate various perspective views of a second class of embodiments of the invention that provides connectors with a plurality of single use contactors that are held together by a tab that can be removed after mounting the contactors to a PCB or other electrical board.
Figure 11B:
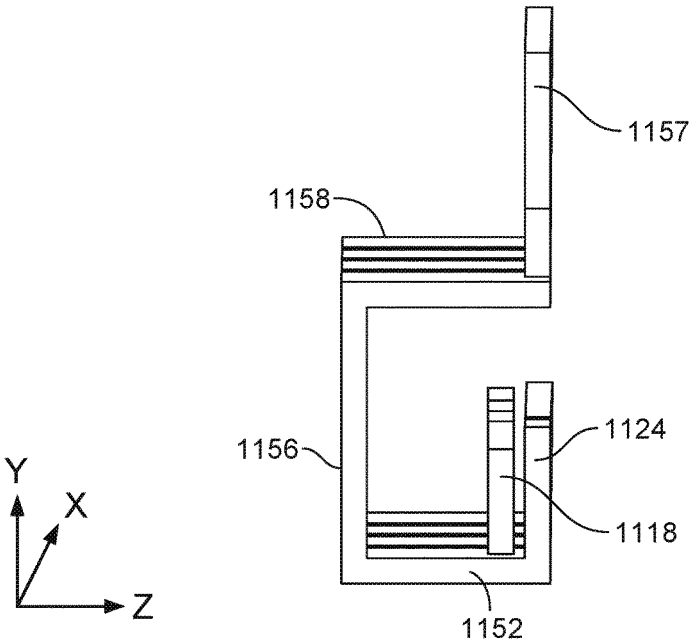
Figure 11C:
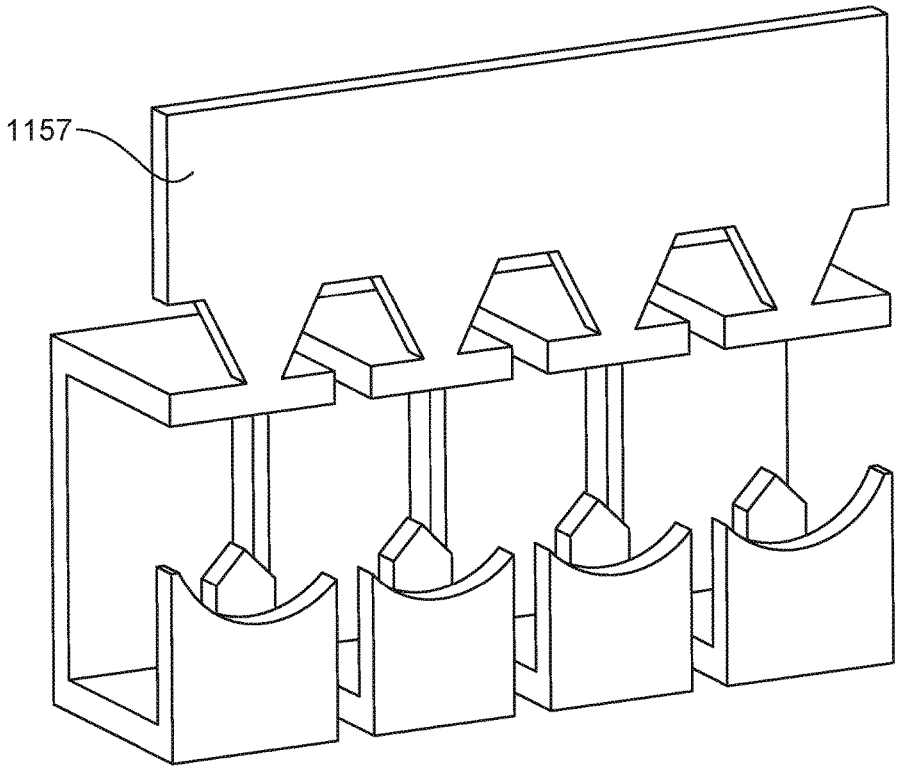

A second embodiment of the invention is shown in the perspective views of FIGS. 11A-11C. This embodiment provides a plurality of single use contactors that are held together by a tab 1157 that can be removed after mounting the contactors to a PCB or other electrical board. Each contactor includes a base 1152 connected on a proximal side to a pedestal 1124 having a curved seat with a bendable spike 1118 located behind the seat. At a distal end the base connects to a back element 1156 or wire stop which in turn connects to a cap or lid 1158. The distance between the cap and the seat approximate the diameter of the bare or coated wire that is to be held. During use a wire is slid into the seat region. As sliding occurs the spike is compliantly bent back. After the wire is inserted (e.g. comes into contact with the back) the wire is pulled forward slightly causing the bent spike to straighten and penetrate any insulator on the wire or simply to bite into the wire thereby making electrical contact between the wire and the contactor.

In some embodiments, the connectors may be mounted to a board by their bases while in other embodiments, their back elements may be mounted to the board. In the former case wire insertion would be parallel to the surface of the board while in the latter case the insertion direction would be perpendicular to the board. In other alternative embodiments, the opening of the connector could be configured to allow an angled insertion. In still other embodiments, the top surface of the connector may be the mounting surface.

In some embodiments the connectors may be formed by stacking layers along the Z-axis with the number of layers and thickness of the layers dictating the depth of the connectors while the length in Y would dictate the height and the length in X would dictate the width of the individual connector elements. In some embodiments the curved seat may be moved from the pedestal to the lid while in other embodiments curved seats may exist on both the pedestal and the lids. In still other embodiments a clamp arm may be mounted on an extra base element or to one of the based elements at the end of an array of contactors and may swing over the top of the other contacts to engage a catch on the opposite sided of the array to help ensure that wires make and retain reliable electrical contact with their respective spikes. In such an alternative a dielectric material may be located on the bottom of the latch arm or on the top of the lids to ensure that no shorting occurs.

Figure 12B:
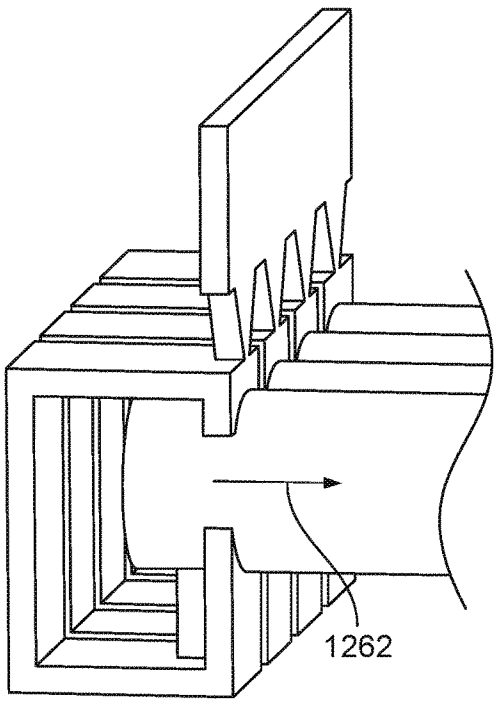
FIGS. 12A-12B illustrate the process of inserting wires into and engaging wires with connectors of the type shown in FIGS. 11A-11C.
Figure 12A:
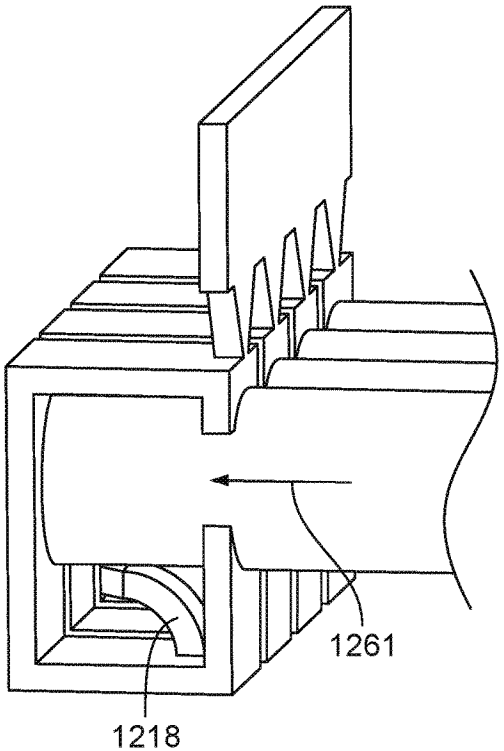

FIGS. 12A-12B illustrate the process of inserting wires into the connectors of FIGS. 11A-11C. In FIG. 12A wires, of a ribbon cable, are inserted into the connectors in the direction indicated by arrow 1261 causing the spikes 1218 to bend. In FIG. 12B the wires are shown as being pulled upon in the direction of arrow 1262 which causes the spikes to straighten and penetrate the insulator to make contact with the internal wires. In the example of FIGS. 12A-12B both the caps and the pedestals are shown as having curved seats for retaining the wires. In other embodiments, the curved seats on the caps could extend the full lengths of the cap to provide extra guidance and/or strengthening of the lid. In some other embodiments. The lids and bases or pedestals may be provided with conductive or dielectric bridge element that strengthens the connectors and that may have sharp edges to provide slitting of the insulator between wires upon insertion. In some embodiments, the individual connectors may provide an insertion hole with sidewalls as well as a cap and pedestal. Either before after insertion of the wires and either before or after mounting to the circuit board the tab that joins the connectors would be removed unless it is formed from a dielectric material.

Figure 13A:
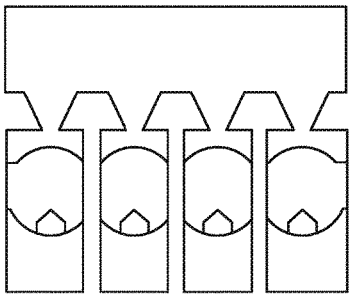
FIGS. 13A-13F provide various additional views of the example connector of FIGS. 11A-11C.
Figure 13B:
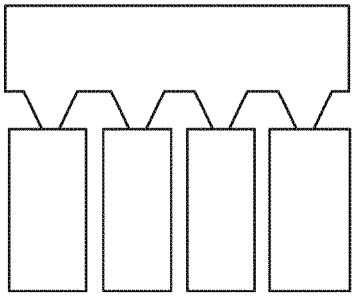
Figure 13C:
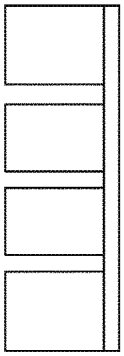
Figure 13D:
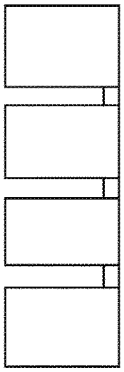
Figure 13E:
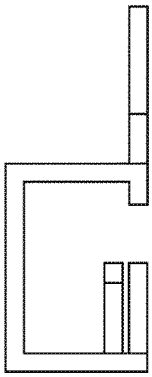
Figure 13F:
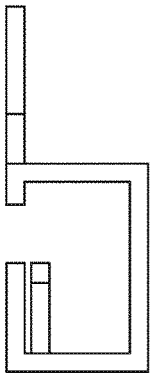

FIGS. 13A-13F provide various additional views of the connector of FIGS. 12A-12B. FIGS. 13A and 13B, respectively, provide a front view and a back view of the connector. FIGS. 13C and 13D, respectively, provide a top view and a bottom view of the connector. FIGS. 13E and 13F, respectively, provide left and right end views of the connector. From FIGS. 13E-13F it can be seen that the connector is formed with as few as 5 distinct layers.

Figure 14:
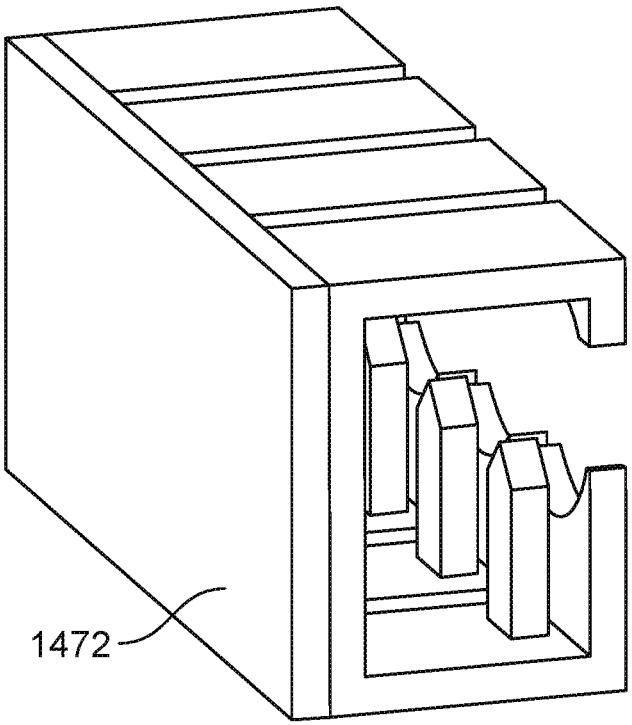
FIG. 14 provides an alternative to the connectors of second embodiment of the invention which include the temporary joining tab being replaced by a dielectric bridge which may stay in place or be removed after mounting to the board.

In some embodiments, particularly where the tab will be replaced by another structure that will remain permanently in place joining a plurality of connectors, it may be formed flat against the lid or flat against the back plate, or bottom surface depending on how electrical connection will be made between the board and the connectors. FIG. 14 illustrates an example of one of these alternatives. In this alternative, the tab is replaced by a dielectric bridge element 1472 connects the individual contactors at least until the individual contacts are mounted to the board. The dielectric can stay in place after mounting or may be removed or may be removed by the mounting process itself.

The various alternatives noted above for the first embodiment also apply to the second embodiment. In some additional variations the back of the individual contactors may have a hole located therein to allow separated wires of the ribbon to pass through during the process of insertion.

Further Comments and Conclusions:

Structural or sacrificial dielectric materials may be incorporated into embodiments of the present invention in a variety of different ways. Such materials may form a third or higher deposited material on selected layers or may form one of the first two materials deposited on some layers. Additional teachings concerning the formation of structures on dielectric substrates and/or the formation of structures that incorporate dielectric materials into the formation process and possibility into the final structures as formed are set forth in a number of patent applications filed Dec. 31, 2003.

The first of these filings is U.S. Patent Application No. 60/534,184 which is entitled "Electrochemical Fabrication Methods Incorporating Dielectric Materials and/or Using Dielectric Substrates". The second of these filings is U.S. Patent Application No. 60/533,932, which is entitled "Electrochemical Fabrication Methods Using Dielectric Substrates". The third of these filings is U.S. Patent Application No. 60/534,157, which is entitled "Electrochemical Fabrication Methods Incorporating Dielectric Materials". The fourth of these filings is U.S. Patent Application No. 60/533,891, which is entitled "Methods for Electrochemically Fabricating Structures Incorporating Dielectric Sheets and/or Seed layers That Are Partially Removed Via Planarization". A fifth such filing is U.S. Patent Application No. 60/533,895, which is entitled "Electrochemical Fabrication Method for Producing Multi-layer Three-Dimensional Structures on a Porous Dielectric". Additional patent filings that provide teachings concerning incorporation of dielectrics into the EFAB process include U.S. patent application Ser. No. 11/139,262, filed May 26, 2005, now U.S. Pat. No. 7,501,328, by Lockard, et al., and which is entitled "Methods for Electrochemically Fabricating Structures Using Adhered Masks, Incorporating Dielectric Sheets, and/or Seed Layers that are Partially Removed Via Planarization"; and U.S. patent application Ser. No. 11/029,216, filed Jan. 3, 2005 by Cohen, et al., now abandoned, and which is entitled "Electrochemical Fabrication Methods Incorporating Dielectric Materials and/or Using Dielectric Substrates". These patent filings are each hereby incorporated herein by reference as if set forth in full herein.

Some embodiments may employ diffusion bonding or the like to enhance adhesion between successive layers of material. Various teachings concerning the use of diffusion bonding in electrochemical fabrication processes are set forth in U.S. patent application Ser. No. 10/841,384 which was filed May 7, 2004 by Cohen et al., now abandoned, which is entitled "Method of Electrochemically Fabricating Multilayer Structures Having Improved Interlayer Adhesion" and which is hereby incorporated herein by reference as if set forth in full. This application is hereby incorporated herein by reference as if set forth in full.

Some embodiments may incorporate elements taught in conjunction with other medical devices as set forth in various U.S. patent applications filed by the owner of the present application and/or may benefit from combined use with these other medical devices: Some of these alternative devices have been described in the following previously filed patent applications: (1) U.S. patent application Ser. No. 11/478,934, by Cohen et al., and entitled "Electrochemical Fabrication Processes Incorporating Non-Platable Materials and/or Metals that are Difficult to Plate On"; (2) U.S. patent application Ser. No. 11/582,049, by Cohen, and entitled "Discrete or Continuous Tissue Capture Device and Method for Making"; (3) U.S. patent application Ser. No. 11/625,807, by Cohen, and entitled "Microdevices for Tissue Approximation and Retention, Methods for Using, and Methods for Making"; (4) U.S. patent application Ser. No. 11/696,722, by Cohen, and entitled "Biopsy Devices, Methods for Using, and Methods for Making"; (5) U.S. patent application Ser. No. 11/734,273, by Cohen, and entitled "Thrombectomy Devices and Methods for Making"; (6) U.S. Patent Application No. 60/942,200, by Cohen, and entitled "Micro-Umbrella Devices for Use in Medical Applications and Methods for Making Such Devices"; and (7) U.S. patent application Ser. No. 11/444,999, by Cohen, and entitled "Microtools and Methods for Fabricating Such Tools". Each of these applications is incorporated herein by reference as if set forth in full herein.

Though the embodiments explicitly set forth herein have considered multi-material layers to be formed one after another. In some embodiments, it is possible to form structures on a layer-by-layer basis but to deviate from a strict planar layer on planar layer build up process in favor of a process that interlaces material between the layers. Such alternative build processes are disclosed in previously referenced U.S. application Ser. No. 10/434,519, filed on May 7, 2003, now U.S. Pat. No. 7,252,861, entitled Methods of and Apparatus for Electrochemically Fabricating Structures Via Interlaced Layers or Via Selective Etching and Filling of Voids. The techniques disclosed in this referenced application may be combined with the techniques and alternatives set forth explicitly herein to derive additional alternative embodiments. In particular, the structural features are still defined on a planar-layer-by-planar-layer basis but material associated with some layers are formed along with material for other layers such that interlacing of deposited material occurs. Such interlacing may lead to reduced structural distortion during formation or improved interlayer adhesion. This patent application is herein incorporated by reference as if set forth in full.

The patent applications and patents set forth below are hereby incorporated by reference herein as if set forth in full. The teachings in these incorporated applications can be combined with the teachings of the instant application in many ways: For example, enhanced methods of producing structures may be derived from some combinations of teachings, enhanced structures may be obtainable, enhanced apparatus may be derived, and the like.

| U.S. patent App No., Filing Date<br>U.S. App Pub No., Pub Date<br>U.S. Pat. No., Pub Date | Inventor, Title |
|---|---|
| 09/493,496-Jan. 28, 2000<br>Pat. 6,790,377-Sep. 14, 2004 | Cohen, "Method For Electrochemical Fabrication" |
| 10/677,556-Oct. 1, 2003<br>2004-0134772-Jul. 15, 2004 | Cohen, "Monolithic Structures Including Alignment and/or Retention Fixtures for Accepting Components" |
| 10/830,262-Apr. 21, 2004<br>2004-0251142A-Dec. 16, 2004<br>Pat. 7,198,704-Apr. 3, 2007 | Cohen, "Methods of Reducing Interlayer Discontinuities in Electrochemically Fabricated Three-Dimensional Structures" |
| 10/271,574-Oct. 15, 2002<br>2003-0127336A-Jul. 10, 2003<br>Pat. 7,288,178-Oct. 30, 2007 | Cohen, "Methods of and Apparatus for Making High Aspect Ratio Microelectromechanical Structures" |
| 10/697,597-Dec. 20, 2002<br>2004-0146650A-Jul. 29, 2004 | Lockard, "EFAB Methods and Apparatus Including Spray Metal or Powder Coating Processes" |
| 10/677,498-Oct. 1, 2003<br>2004-0134788-Jul. 15, 2004<br>Pat. 7,235,166-Jun. 26, 2007 | Cohen, "Multi-cell Masks and Methods and Apparatus for Using Such Masks To Form Three-Dimensional Structures" |

-continued

| U.S. patent App No., Filing Date<br>U.S. App Pub No., Pub Date<br>U.S. Pat. No., Pub Date | Inventor, Title |
|---|---|
| 10/724,513-Nov. 26, 2003<br>2004-0147124-Jul. 29, 2004<br>Pat. 7,368,044-May 6, 2008 | Cohen, "Non-Conformable Masks and Methods and Apparatus for Forming Three-Dimensional Structures" |
| 10/607,931-Jun. 27, 2003<br>2004-0140862-Jul. 22, 2004<br>Pat. 7,239,219-Jul. 3, 2007 | Brown, "Miniature RF and Microwave Components and Methods for Fabricating Such Components" |
| 10/841,100-May 7, 2004<br>2005-0032362-Feb. 10, 2005<br>Pat. 7,109,118-Sep. 19, 2006 | Cohen, "Electrochemical Fabrication Methods Including Use of Surface Treatments to Reduce Overplating and/or Planarization During Formation of Multi-layer Three-Dimensional Structures" |
| 10/387,958-Mar. 13, 2003<br>2003-022168A-Dec. 4, 2003 | Cohen, "Electrochemical Fabrication Method and Application for Producing Three-Dimensional Structures Having Improved Surface Finish" |
| 10/434,494-May 7, 2003<br>2004-0000489A-Jan. 1, 2004 | Zhang, "Methods and Apparatus for Monitoring Deposition Quality During Conformable Contact Mask Plating Operations" |
| 10/434,289-May 7, 2003<br>20040065555A-Apr. 8, 2004 | Zhang, "Conformable Contact Masking Methods and Apparatus Utilizing In Situ Cathodic Activation of a Substrate" |
| 10/434,294-May 7, 2003<br>2004-0065550A-Apr. 8, 2004 | Zhang, "Electrochemical Fabrication Methods With Enhanced Post Deposition Processing" |
| 10/434,295-May 7, 2003<br>2004-0004001A-Jan. 8, 2004 | Cohen, "Method of and Apparatus for Forming Three-Dimensional Structures Integral With Semiconductor Based Circuitry" |
| 10/434,315-May 7, 2003<br>2003-0234179 A-Dec. 25, 2003<br>Pat. 7,229,542-Jun. 12, 2007 | Bang, "Methods of and Apparatus for Molding Structures Using Sacrificial Metal Patterns" |
| 10/434,103-May 7, 2004<br>2004-0020782A-Feb. 5, 2004<br>Pat. 7,160,429-Jan. 9, 2007 | Cohen, "Electrochemically Fabricated Hermetically Sealed Microstructures and Methods of and Apparatus for Producing Such Structures" |
| 10/841,006-May 7, 2004<br>2005-0067292-May 31, 2005 | Thompson, "Electrochemically Fabricated Structures Having Dielectric or Active Bases and Methods of and Apparatus for Producing Such Structures" |
| 10/434,519-May 7, 2003<br>2004-0007470A-Jan. 15, 2004<br>Pat. 7,252,861-Aug. 7, 2007 | Smalley, "Methods of and Apparatus for Electrochemically Fabricating Structures Via Interlaced Layers or Via Selective Etching and Filling of Voids" |
| 10/724,515-Nov. 26, 2003<br>2004-0182716-Sep. 23, 2004<br>Pat. 7,291,254-Nov. 6, 2007 | Cohen, "Method for Electrochemically Forming Structures Including Non-Parallel Mating of Contact Masks and Substrates" |
| 10/841,347-May 7, 2004<br>2005-0072681-Apr. 7, 2005 | Cohen, "Multi-step Release Method for Electrochemically Fabricated Structures" |
| 60/533,947-Dec. 31, 2003 | Kumar, "Probe Arrays and Method for Making" |
| 60/534,183-Dec. 31, 2003 | Cohen, "Method and Apparatus for Maintaining Parallelism of Layers and/or Achieving Desired Thicknesses of Layers During the Electrochemical Fabrication of Structures" |
| 11/733,195-Apr. 9, 2007<br>2008-0050524-Feb. 28, 2008 | Kumar, "Methods of Forming Three-Dimensional Structures Having Reduced Stress and/or Curvature" |
| 11/506,586-Aug. 8,2006<br>2007-0039828-Feb. 22, 2007<br>Pat. 7,611,616-Nov. 3, 2009 | Cohen, "Mesoscale and Microscale Device Fabrication Methods Using Split Structures and Alignment Elements" |
| 10/949,744-Sep. 24, 2004<br>2005-0126916-Jun. 16, 2005<br>Pat. 7,498,714-Mar. 3, 2009 | Lockard, "Three-Dimensional Structures Having Feature Sizes Smaller Than a Minimum Feature Size and Methods for Fabricating" |

Though various portions of this specification have been provided with headers, it is not intended that the headers be used to limit the application of teachings found in one portion of the specification from applying to other portions of the specification. For example, it should be understood that alternatives acknowledged in association with one embodiment, are intended to apply to all embodiments to the extent that the features of the different embodiments make such application functional and do not otherwise contradict or remove all benefits of the adopted embodiment. Various other embodiments of the present invention exist. Some of these embodiments may be based on a combination of the teachings herein with various teachings incorporated herein by reference.

In view of the teachings herein, many further embodiments, alternatives in design and uses of the embodiments of the instant invention will be apparent to those of skill in the art. As such, it is not intended that the invention be limited to the particular illustrative embodiments, alternatives, and uses described above but instead that it be solely limited by the claims presented hereafter.

I claim:

1. A board mountable connector, comprising:

a plurality of electrically conductive isolated spikes comprising a distal end and a proximal end, where the distal end of each spike is configured to engage an individual wire of a multi-wire ribbon cable;

a plurality of pedestals which are each configured to connect to the proximal end of a spike of the plurality of spikes with each pedestal including a board mounting location;

a latching element;

a clamping arm rotatably mounted to move from an open position to a latched position when engaged with the latching element such that wires of a ribbon cable, when inserted between the arm and the spikes, make electrical contact with a respective spike;

wherein the spikes, pedestals and latching arm are configured to engage a ribbon cable having wires smaller than 28 AWG, wherein the connector is formed from a plurality of adhered layers and wherein the layers are distinguishable by stair stepped side features.

2. The connector of claim 1 wherein the wires are selected from a gauge selected from the group consisting of wires smaller than (1) 32 AWG, (2) 34 AWG, (3) 36 AWG, (4) 38 AWG, and (5) 40 AWG.

3. The connector of claim 1 wherein the board mountable connector is configured to accommodate a ribbon having a number of wires selected from the group consisting of (1) at least two wires, (2) at least four wires, (3) at least six wires, and (4) at least eight wires.

4. The connector of claim 1 wherein the individual spikes have tips that are formed within a single layer.

5. The connector of claim 1 wherein the layer thickness for at least some layers is selected from the group consisting of (1) less than 50 microns, (2) less than 30 microns, (3) less than 20 microns, and (4) less than 10 microns.

6. The connector of claim 1 wherein the connector comprises at least two different metals.

7. The connector of claim 6 wherein at least two different metals exist on the same layer.

8. The connector of claim 1 wherein the connector comprises at least one metal and at least one dielectric electrically isolating the plurality of spikes.

9. The connector of claim 1 wherein the connector comprises a material for improving bonding to a circuit board.

10. A board mountable connector comprising a plurality of individual contactor elements:

a plurality of electrically conductive isolated spikes comprising a distal end and a proximal end, where the distal end of each spike is configured to engage an individual wire of a multi-wire ribbon cable;

a plurality of pedestals which each connect, directly or indirectly to the proximal end of a respective spike of the plurality of spikes with each pedestal electrically isolated from the other pedestals and with each comprising a curved seat for locating an insulator of a wire;

a plurality of base elements connecting the respective spikes to a proximal end of respective back stop elements;

a plurality of cap elements located above respective spikes and connected to a distal end of respective back elements, wherein spacings between respective lids and seats and seats and spikes is configured to allow insertion of a wire of a multi-wire ribbon cable between the lids and the seats while bending back the spikes;

wherein spacings between respective lids and seats and seats and spikes is configured such that partial retraction of the wires causes the spikes to straighten, penetrate an insulating coating on the respective wire and make electrical contact;

wherein the spikes, lids, and stops are configured to engage a ribbon cable having wires smaller than 28 AWG, and wherein each individual contactor element comprises at least one of the spikes, pedestals, base elements, and cap elements.

11. The connector of claim 10 wherein the wires are selected from a gauge selected from the group consisting of wires smaller than (1) 32 AWG, (2) 34 AWG, (3) 36 AWG, (4) 38 AWG, and (5) 40 AWG.

12. The connector of claim 10 wherein the board mountable connector is configured to accommodate a ribbon having a number of wires selected from the group consisting of (1) at least two wires, (2) at least four wires, (3) at least six wires, and (4) at least eight wires.

13. The connector of claim 10 formed from a plurality of adhered layers wherein the layers are distinguishable by stair stepped side features.

14. The connector of claim 10 wherein the individual spikes have tips that are formed within a single layer.

15. The connector of claim 13 wherein the layer thickness for at least some layers is selected from the group consisting of (1) less than 50 microns, (2) less than 30 microns, (3) less than 20 microns, and (4) less than 10 microns.

16. The connector of claim 13 wherein the connector comprises at least two different metals.

17. The connector of claim 16 wherein at least two different metals exist on the same layer.

18. The connector of claim 13 wherein the connector comprises at least one metal and at least one dielectric electrically isolating the plurality of spikes.

19. The connector of claim 10 wherein the connector comprises a material for improving bonding to a circuit board.

* * * * *